US012791227B1

(12) United States Patent
Taylor

(10) Patent No.: US 12,791,227 B1
(45) Date of Patent: Nov. 10, 2026

(54) PORTABLE RENEWABLE GEOTHERMAL ENERGY HARVESTING SYSTEMS AND METHODS

(71) Applicant: Mark H. Taylor, Gibsland, LA (US)

(72) Inventor: Mark H. Taylor, Gibsland, LA (US)

( * ) Notice: Subject to any disclaimer, the term of this patent is extended or adjusted under 35 U.S.C. 154(b) by 119 days.

(21) Appl. No.: 18/752,128

(22) Filed: Jun. 24, 2024

(51) Int. Cl.
*F24T 10/20* (2018.01)
*F24T 50/00* (2018.01)
*F24T 10/00* (2018.01)

(52) U.S. Cl.
CPC ..... *F24T 10/20* (2018.05); *F24T 50/00* (2018.05); *F24T 2010/53* (2018.05); *F24T 2010/56* (2018.05)

(58) Field of Classification Search
CPC . F24T 10/10–17; F24T 10/20; F24T 2010/53; F24T 2010/56; F24T 50/00; Y02E 10/10; F03G 4/001; F03G 4/029
See application file for complete search history.

(56) References Cited

U.S. PATENT DOCUMENTS

| | | | | |
|---|---|---|---|---|
| 4,059,959 | A | 11/1977 | Matthews | |
| 5,372,016 | A | 12/1994 | Rawlings | |
| 11,421,516 | B2 | 8/2022 | Bowdon et al. | |
| 11,434,880 | B1 | 9/2022 | Taylor | |
| 2007/0251237 | A1 | 11/2007 | Zachar | |
| 2009/0126923 | A1 | 5/2009 | Montgomery | |
| 2009/0321040 | A1 | 12/2009 | Poitras | |
| 2011/0272166 | A1 | 11/2011 | Hunt | |
| 2014/0130498 | A1 | 5/2014 | Randolph | |
| 2019/0093641 | A1* | 3/2019 | Sumrall | F03G 7/04 |
| 2019/0346181 | A1 | 11/2019 | Toews | |
| 2022/0316456 | A1* | 10/2022 | Bodishbaugh | F03G 4/06 |

FOREIGN PATENT DOCUMENTS

| | | |
|---|---|---|
| WO | WO2012/151487 | 11/2012 |
| WO | WO2017/053884 | 3/2017 |
| WO | WO2019/157341 | 8/2019 |
| WO | WO2022/170387 | 8/2022 |
| WO | WO2022/170390 | 8/2022 |

* cited by examiner

*Primary Examiner* — Loren C Edwards
(74) *Attorney, Agent, or Firm* — R. Keith Harrison

(57) ABSTRACT

Portable renewable energy harvesting systems may include a subterranean geothermal well disposed in thermally conductive communication with a geothermal formation. A portable heat exchanger unit may include a fluid heat exchanger. A primary fluid pump may be disposed in fluid communication with the fluid heat exchanger. A secondary fluid pump may be disposed in fluid communication with the fluid heat exchanger. A portable energy generating unit may be configured to generate and utilize thermal energy from the geothermal well. A primary fluid loop may include the fluid heat exchanger, the primary fluid pump and the geothermal well. A secondary fluid loop may include the fluid heat exchanger, the secondary fluid pump and the portable energy generating unit. Geothermal energy can be extracted from the secondary fluid loop and used in any of various energy applications. Portable renewable energy harvesting methods are also disclosed.

20 Claims, 16 Drawing Sheets

PORTABLE RENEWABLE GEOTHERMAL ENERGY HARVESTING SYSTEMS AND METHODS

FIELD

Illustrative embodiments of the disclosure relate to renewable energy. More particularly, illustrative embodiments of the disclosure relate to renewable geothermal energy harvesting systems and methods in which portable system units can be transported and deployed at a subterranean geothermal well to assemble and operate the system for extraction of geothermal energy from the well for any of various energy applications.

BACKGROUND

The background description provided herein is solely for the purpose of generally presenting the context of the illustrative embodiments of the disclosure. Aspects of the background description are neither expressly nor impliedly admitted as prior art against the claimed subject matter.

In recent years, measures have been devised and implemented to combat climate change. A major initiative in this effort has been to increase exploitation of "Green Energy" or renewable energy sources. Green energy implements a range of measures to reduce carbon dioxide (CO.sub.2) emissions to the atmosphere.

Among the most common types of green energy are the renewable wind power and solar power. These energy sources, however, may be unpredictable and not continually available. Wind and solar energy technologies typically require extensive infrastructure and the associated maintenance and braking power sources. These drawbacks are setbacks in attempts to mitigate climate change.

Still further, there is continuing interest in maximizing the efficiency and utility of geothermal energy systems. In one sense, the Earth itself may be viewed as potentially forming an exceedingly large, ready-made energy recovery/storage device or reservoir.

Accordingly, renewable geothermal energy harvesting systems and methods in which portable system units can be transported and deployed at a subterranean geothermal well to assemble and operate the system for extraction of geothermal energy from the well are needed.

SUMMARY

Illustrative embodiments of the disclosure are generally directed to portable renewable geothermal energy harvesting methods in which portable system units can be transported and deployed at a subterranean geothermal well to assemble and operate the system for extraction of geothermal energy from the well for any of various energy applications. An illustrative embodiment of the renewable geothermal energy harvesting methods may include transporting a portable heat exchanger unit having a fluid heat exchanger to a geothermal well extending into a geothermal formation; transporting a portable energy generating unit to the geothermal well; forming a primary fluid loop by continuously performing the following: distributing a primary fluid through the geothermal well into thermal contact with the geothermal formation; transferring thermal energy from the geothermal formation to the primary fluid; distributing the primary fluid from the geothermal formation through the fluid heat exchanger; and distributing the primary fluid back to the geothermal well; forming a secondary fluid loop by continuously distributing a secondary fluid through the fluid heat exchanger, transferring thermal energy from the primary fluid to the secondary fluid at the fluid heat exchanger and utilizing the thermal energy in the secondary fluid to perform work at the portable energy generating unit.

Illustrative embodiments of the disclosure are further generally directed to portable renewable energy harvesting systems having portable system units which can be transported and deployed at a subterranean geothermal well to assemble and operate the system for extraction of geothermal energy from the well for any of various energy applications. An illustrative embodiment of the systems may include a subterranean geothermal well. The geothermal well may be disposed in thermally conductive communication with a geothermal formation. A portable heat exchanger unit may include a fluid heat exchanger. A primary fluid pump may be disposed in fluid communication with the fluid heat exchanger. A secondary fluid pump may be disposed in fluid communication with the fluid heat exchanger. A portable energy generating unit may be configured to generate and utilize thermal energy from the geothermal well. A primary fluid loop may include the fluid heat exchanger, the primary fluid pump and the geothermal well. A secondary fluid loop may include the fluid heat exchanger, the secondary fluid pump and the portable energy generating unit. Geothermal energy can be extracted from the secondary fluid loop and used in any of various energy applications.

BRIEF DESCRIPTION OF THE DRAWINGS

Illustrative embodiments of the disclosure will now be described, by way of example, with reference to the accompanying drawings, in which.

DETAILED DESCRIPTION

Figure 1:
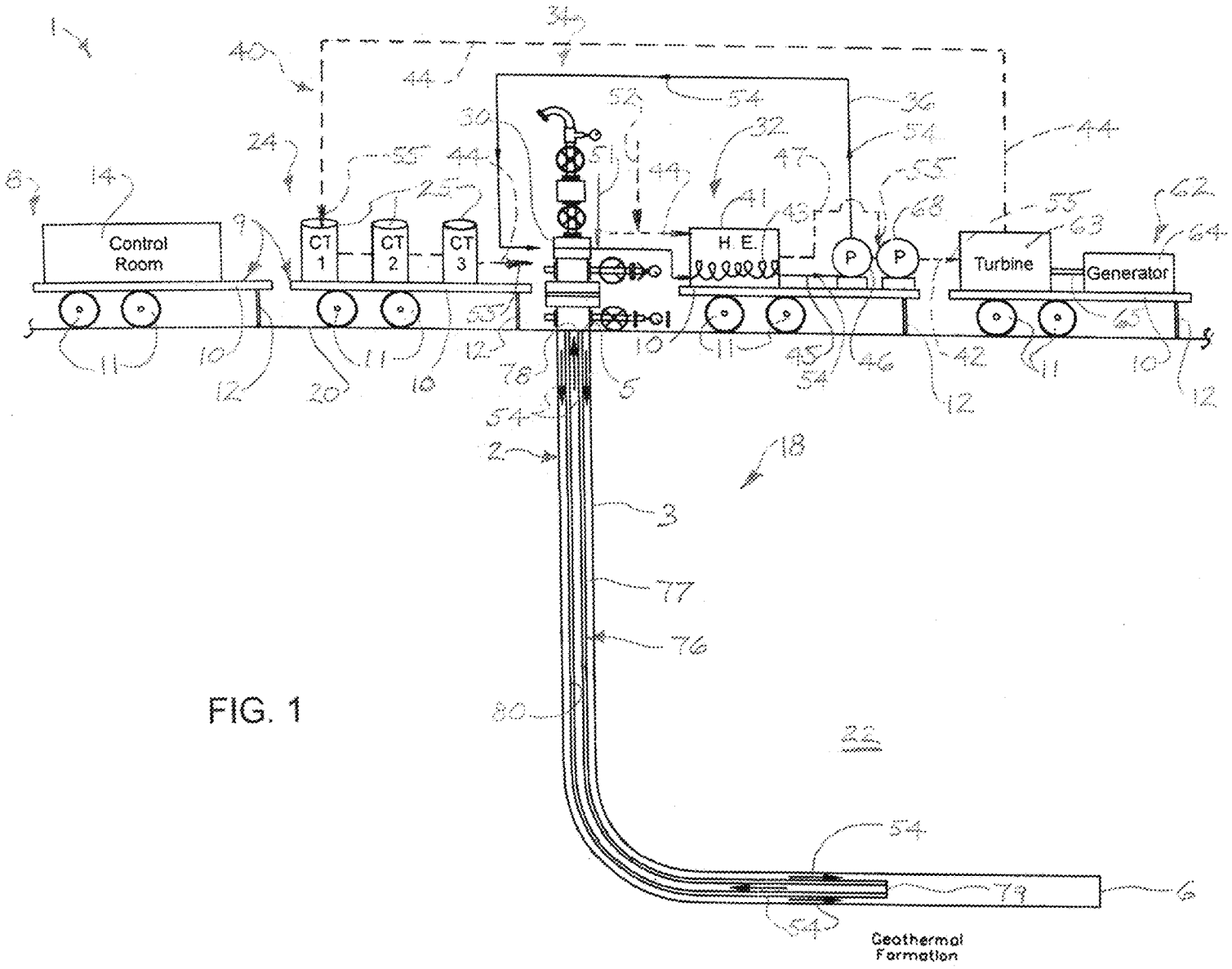
FIG. 1 is a sectioned view of a subterranean geothermal well with an illustrative embodiment of the portable renewable geothermal energy harvesting systems deployed in place at the geothermal well to convert geothermal energy to electrical energy according to some applications of the system.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the subject matter as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

All methods set forth in the present disclosure may be performed in any suitable order of steps unless otherwise indicated herein or contradicted by the rules of logic. The use of any and all examples or exemplary language provided herein is intended to clearly describe the subject matter of the disclosure and is not intended to be limiting on the scope of the subject matter set forth in the claims. No element, step, ingredient, or limitation mentioned or described in the specification shall not be construed as regarding any unclaimed component, step, or limitation to be essential in practicing the claimed subject matter.

Unless expressly or implicitly indicated otherwise, throughout the description and the appended claims, the terms "comprise", "comprising", "comprised of" and the like are to be construed in an inclusive sense as opposed to an exclusive or exhaustive sense, and are equivalent to the phrase, "including but not limited to". Each embodiment disclosed herein can comprise, consist essentially of, or consist of its particular stated element, step, ingredient, or limitation. As used herein, the transition terms "comprise", "comprises", "comprising", "include", "includes", "including", "is", "has", "having" or the like means "includes, but is not limited to, and allows for the inclusion of unspecified elements, steps, ingredients, or limitations, even in major amounts". The transitional phrase "consisting of" excludes any element, step, ingredient, or limitation not specified. The transition phrase "consisting essentially of" shall limit the scope of the embodiment to the specified elements, steps, ingredients, or limitations and to those that do not materially affect the embodiment. Throughout the written description, drawings and claims appended hereto, unless otherwise noted, it shall be recognized and understood that each embodiment of the described, illustrated and claimed subject matter may comprise, consist essentially of, or consist of any component, element or combination of components or elements set forth herein.

Unless otherwise noted using precise or limiting terminology, all numbers which express quantities of ingredients throughout the specification and claims are to be understood as being approximations of the numerical value cited to express the quantities of those ingredients. As used throughout the specification and claims, the term "about" has the meaning reasonably ascribed to it by a person skilled in the art when used in conjunction with a stated numerical value or range, i.e., denoting from the exact stated value or range to somewhat more or somewhat less than the stated value or range, from a deviation of from 0% with respect to the stated value or range to up to and including 20% of the stated value or range in either direction.

Various illustrative embodiments of the disclosure are described herein. Variations on the described illustrative embodiments may become apparent to those of ordinary skill in the art in reading the specification, drawings and claims of the disclosure. Accordingly, the disclosure encompassed by the specification, claims and drawings includes all modifications and equivalents of the subject matter recited in the claims as permitted by applicable law. Additionally, any combination of the elements in all possible variations thereof is encompassed by the subject matter of the disclosure unless otherwise indicated herein.

The term "or combinations thereof as used herein refers to all permutations and combinations of the listed items preceding the term. For example, "A, B, C, or combinations thereof is intended to include at least one of A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

Illustrative embodiments of the disclosure are generally directed to portable renewable geothermal energy harvesting methods in which portable system units can be transported and deployed at a subterranean geothermal well to assemble and operate the system for extraction of geothermal energy from the well for any of various energy applications. An illustrative embodiment of the renewable geothermal energy harvesting methods may include transporting a portable heat exchanger unit having a fluid heat exchanger to a geothermal well extending into a geothermal formation; transporting a portable energy generating unit to the geothermal well; forming a primary fluid loop by continuously performing the following: distributing a primary fluid through the geothermal well into thermal contact with the geothermal formation; transferring thermal energy from the geothermal formation to the primary fluid; distributing the primary fluid from the geothermal formation through the fluid heat exchanger; and distributing the primary fluid back to the geothermal well; forming a secondary fluid loop by continuously distributing a secondary fluid through the fluid heat exchanger, transferring thermal energy from the primary fluid to the secondary fluid at the fluid heat exchanger and utilizing the thermal energy in the secondary fluid to perform work at the portable energy generating unit.

Illustrative embodiments of the disclosure are further generally directed to portable renewable energy harvesting systems having portable system units which can be transported and deployed at a subterranean geothermal well to assemble and operate the system for extraction of geothermal energy from the well for any of various energy applications. An illustrative embodiment of the systems may include a subterranean geothermal well. The geothermal well may be disposed in thermally conductive communication with a geothermal formation. A portable heat exchanger unit may include a fluid heat exchanger. A primary fluid pump may be disposed in fluid communication with the fluid heat exchanger. A secondary fluid pump may be disposed in fluid communication with the fluid heat exchanger. A portable energy generating unit may be configured to generate and utilize thermal energy from the geothermal well. A primary fluid loop may include the fluid heat exchanger, the primary fluid pump and the geothermal well. A secondary fluid loop may include the fluid heat exchanger, the secondary fluid pump and the portable energy generating unit. Geothermal energy can be extracted from the secondary fluid loop and used in any of various energy applications. The portable renewable geothermal energy harvesting methods and systems may be used in emergency response efforts in natural disasters and/or to provide temporary power for municipalities and/or the military, for example and without limitation.

Figure 2:
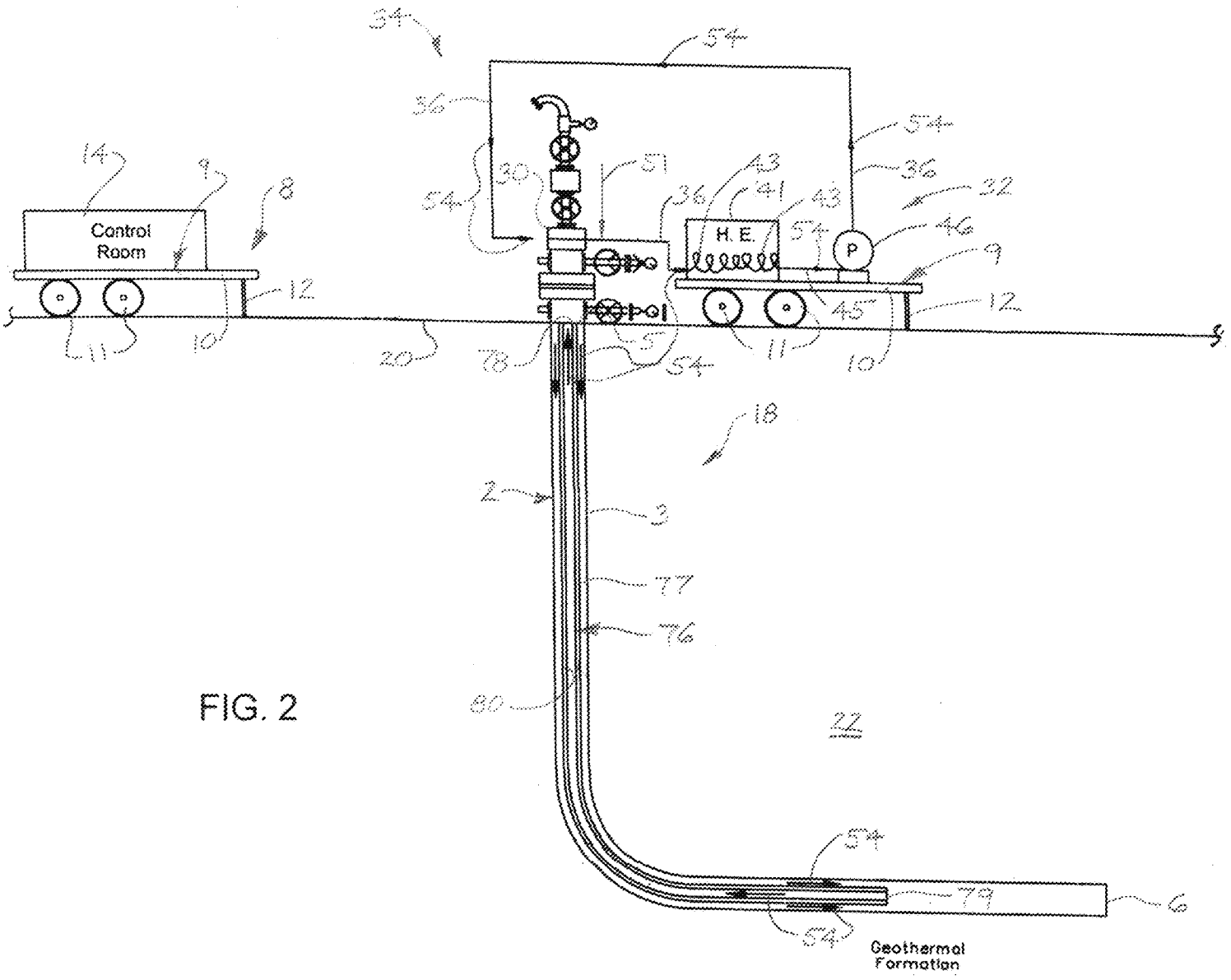
FIG. 2 is a sectioned view of the geothermal well illustrated in FIG. 1, more particularly illustrating a portable control room unit and a portable heat exchanger unit deployed in proximity to the geothermal well and a primary fluid loop of the system circulating primary fluid through the geothermal well and through a heat exchanger of the portable heat exchanger unit in typical application of the system.
Figure 3:
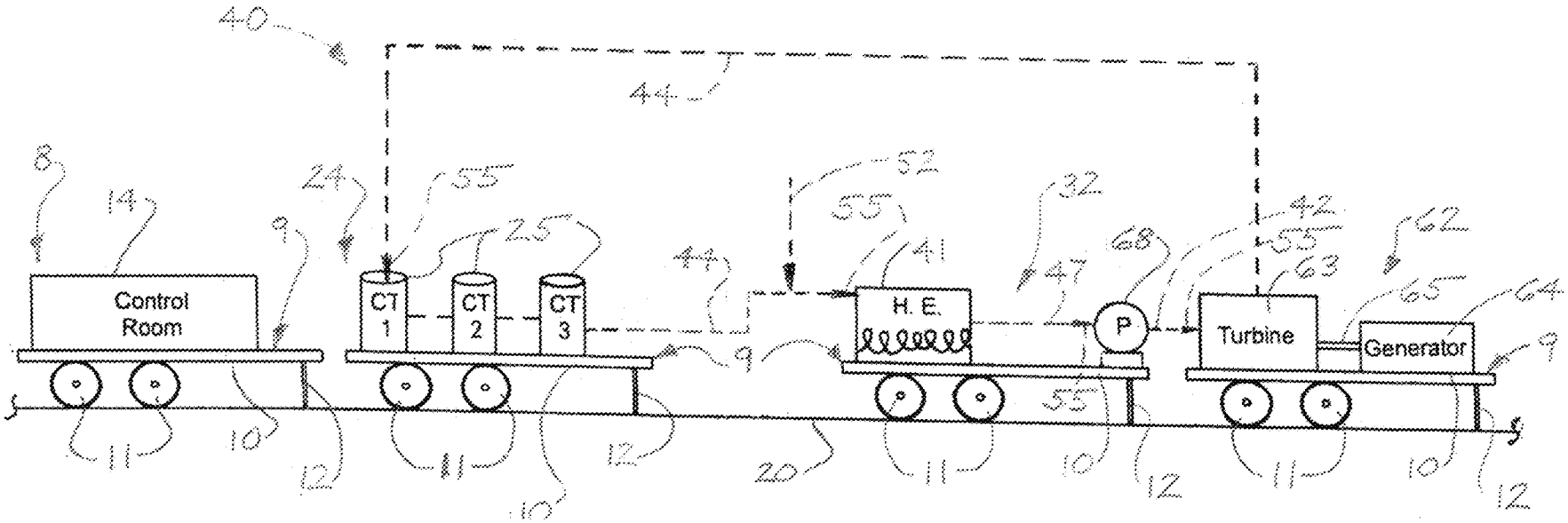
FIG. 3 is a sectioned view of the geothermal well illustrated in FIG. 1, with a portable cooling tower unit and a portable energy generating unit deployed in proximity to the geothermal well and a secondary fluid loop of the system circulating secondary fluid through the heat exchanger and through cooling towers on the cooling tower unit to heat the secondary fluid from the primary fluid in typical application of the system.

Referring initially to FIGS. 1-3 of the drawings, an illustrative embodiment of the portable renewable geothermal energy harvesting systems, hereinafter system, is generally indicated by reference numeral 1. The system 1 may be assembled or deployed at a subterranean geothermal well 18 to extract geothermal energy from the geothermal well 18 for any of various energy applications. The subterranean geothermal well 18 may be disposed in thermally conductive communication with a subterranean geothermal formation 22.

The geothermal well 18 of the system 1 may include a subterranean well casing 2. The well casing 2 may be deployed in a drilled wellbore (not numbered) which extends into the geothermal formation 22. In some applications, the well casing 2 may be part of an existing well in the oil and gas industry, or may alternatively be a newly installed well which is dedicated to use as a component part of the system 1. In the former case, the conversion of existing oil and gas wells to geothermal recovery wells to produce green energy using the systems and methods will extend the useful life of marginal or depleted wells. In the latter case, the wellbore may be drilled and the well casing 2 installed in the wellbore as part of a dedicated geothermal well.

The well casing 2 may have any length necessary to reach the subterranean geothermal formation 22. The wellbore in which the well casing 2 is installed may have any trajectory and may be vertical, horizontal, or any angle between vertical and horizontal at any point or points along its length. For example and without limitation, as illustrated in FIGS. 1 and 2, in some embodiments, the well casing 2 may have a proximal, upper segment which is vertical and a distal, lower segment which is horizontal.

The well casing 2 may have a typically steel well casing wall 3 with a proximal casing end 5 which terminates at or near a ground surface 20 and a distal casing end 6 which terminates within the geothermal formation 2. In some embodiments, a well casing lining (not illustrated), typically cement or grout, may line the outer surface of the well casing wall 3.

In some embodiments, the well casing wall 3 and the distal casing end 6 of the well casing 2 may be fluidly sealed from the geothermal formation 22. Accordingly, in the case of an existing depleted oil or gas well, casing perforations (not illustrated) may extend through the well casing wall 3 of the well casing 2. In implementation of the system 1, the casing perforations may be closed or sealed off typically according to the knowledge of those skilled in the art. In some embodiments, such as in the case of a well drilled for the dedicated purpose of the renewable geothermal energy harvesting systems and methods, the casing perforations may be omitted from the well casing wall 3 and the distal casing end 6 of the well casing 2 closed off.

A fluid flow conduit 76, such as a tubing string, for example and without limitation, may extend from the ground surface 20 into the well casing 2. The fluid flow conduit 76 may have a fluid flow conduit wall 77 with a proximal conduit end 78 disposed at or near the ground surface 20 and a distal conduit end 79 disposed in the well casing 2. The fluid flow conduit wall 77 may be fabricated of a material or combination of materials having a low specific heat or high thermal conductivity. In some embodiments, thermal insulation (not illustrated) may surround the fluid flow conduit wall 77 of the fluid flow conduit 76.

A well annulus 80 may be formed by and between the interior surface of the well casing wall 3 and the exterior surface of the fluid flow conduit 76. The distal conduit end 79 of the fluid flow conduit 76 may be open to establish fluid communication between the well annulus 80 and the conduit interior of the fluid flow conduit 76.

At least one wellhead 30 may be disposed in fluid communication with the open proximal conduit end 78 of the fluid flow conduit 76 and with the well annulus 80 at the ground surface 20. The wellhead 30 may facilitate fluid communication of the well annulus 80 and the fluid flow conduit 76 with at least some of the various functional components of the system 1, which will be hereinafter described. The wellhead 30 may include conduits and valves which facilitate controlled and regulated flow of fluids throughout the system 1, which will be hereinafter described, as well as pressure gauges which indicate well pressures and the like.

The system 1 may include at least one portable heat exchanger unit 32. The portable heat exchanger unit 32 may include a fluid heat exchanger 41. A primary fluid pump 46 and a secondary fluid pump 68 may be disposed in fluid communication with the fluid heat exchanger 41, typically for purposes which will be hereinafter described.

The system 1 may further include at least one portable energy generating unit 62. The portable energy generating unit 62 may be configured to generate and utilize thermal energy from the geothermal well 18, typically as will be hereinafter described. In some embodiments, the portable energy generating unit 62 may include a turbine 63. An electrical generator 64 may be drivingly engaged by the turbine 63 through a suitable mechanical electrical generator coupling 65. The turbine 63 may be operable by thermal energy harvested from the geothermal well 18 and configured to drive the electrical generator 64 via the electrical generator coupling 65, typically as will be hereinafter described, for generation of electrical power.

In some embodiments, the system 1 may include at least one portable cooling tower unit 24. The portable cooling tower unit 24 may include at least one cooling tower 25. The purpose of the portable cooling tower unit 24 will be hereinafter described.

In some embodiments, the system 1 may include at least one portable control room unit 8. The portable control room unit 8 may include at least one control room 14. The control room 14 of the portable control room unit 8 may be configured to facilitate operation of the various components of the portable heat exchanger unit 32, the portable energy generating unit 62 and the portable cooling tower unit 24 from a single location, typically as will be hereinafter described.

The system 1 may include at least one primary fluid loop 34. The primary fluid loop 34 may be configured to circulate a primary fluid 54 in a continuous circuit. As particularly illustrated in FIG. 2, the primary fluid loop 34 of the system 1 may include the geothermal well 18 and the fluid heat exchanger 41 and the primary fluid pump 46 of the portable heat exchanger unit 32. Accordingly, the primary fluid pump 46 of the portable heat exchanger unit 32 may be operable to pump the primary fluid 54 downwardly into the geothermal well 18 through the well annulus 80 and then upwardly from the geothermal well 18 through the fluid flow conduit 76 and through the fluid heat exchanger 41 and back to the geothermal well 18 in the continuous circuit. Alternatively, the primary fluid 54 may flow into the geothermal well 18 through the fluid flow conduit 76 and from the geothermal well 18 through the well annulus 80. As it flows through the well annulus 80 and/or the fluid flow conduit 76, the primary fluid 54 may be heated to a selected target temperature typically by conductive transfer of thermal energy from the geothermal formation 22 through the well casing wall 3 of the well casing 2 to the primary fluid 54, typically for purposes which will be hereinafter described. The primary fluid 54 may include at least one refrigerant and/or other fluid or combination of fluids having a high specific heat or high boiling point.

The system 1 may include a secondary fluid loop 40. The secondary fluid loop 40 may be configured to circulate a secondary fluid 55 in a continuous circuit. As particularly illustrated in FIG. 3, the secondary fluid loop 40 of the system 1 may include the fluid heat exchanger 41 and the secondary fluid pump 68 of the portable heat exchanger unit 32 and the turbine 63 of the portable energy generating unit 62. Accordingly, the secondary fluid pump 68 of the portable heat exchanger unit 32 may be operable to pump the secondary fluid 55 from the heat exchanger 41 through the turbine 63 of the portable energy generating unit 62 and back through the heat exchanger 41 in the continuous circuit. The secondary fluid 54 may include at least one refrigerant and/or other fluid or combination of fluids having a low specific heat or low boiling point. For example and without limitation, in some embodiments, the secondary fluid 54 may include water.

In some embodiments, the secondary fluid loop 40 of the system 1 may include the portable cooling tower unit 24. The cooling tower or towers 25 of the portable cooling tower unit 24 may be disposed in fluid communication with the turbine 63 of the portable energy generating unit 63 and with the fluid heat exchanger 41 of the portable heat exchanger unit 32. Accordingly, responsive to operation of the secondary fluid pump 68, the secondary fluid 55 may flow from the fluid heat exchanger 41 of the heat exchanger unit 32 and the turbine 63 of the portable energy generating unit 62 and then through the cooling tower or towers 25 of the cooling tower unit 24, and back through the fluid heat exchanger 41, respectively. As it flows through the fluid heat exchanger 41 of the portable heat exchanger unit 32, thermal energy may be transferred from the primary fluid 54 in the primary fluid loop 34 to the secondary fluid 55 in the secondary fluid loop 40, which may cause the secondary fluid 55 to vaporize from the liquid phase. As it subsequently flows through the cooling towers 25, the secondary fluid 55 may condense from the vapor phase back to the liquid phase.

As illustrated in FIGS. 1 and 2, the primary fluid loop 34 of the system 1 may include at least one recirculation conduit 36. The recirculation conduit 36 may establish fluid communication between the primary fluid pump 46 of the portable heat exchanger unit 32 and the wellhead 30 of the geothermal formation 22 and between the wellhead 30 and the fluid heat exchanger 41 of the portable heat exchanger unit 32. The recirculation conduit 36 may be configured for releasable connection to the primary fluid pump 46, the wellhead 30 and the fluid heat exchanger 41 typically as will be hereinafter described. A primary fluid supply 51, which contains a reservoir or supply of the primary fluid 54, may be disposed in fluid communication with the recirculation conduit 36, as illustrated, and/or other conduit or component of the primary fluid loop 34.

As illustrated in FIGS. 1 and 3, the secondary fluid loop 40 of the system 1 may include at least one distribution conduit 42. The distribution conduit 42 may establish fluid communication between the secondary fluid pump 68 of the portable heat exchanger unit 32 and the turbine 63 of the portable energy generating unit 62. The secondary fluid loop 40 may include at least one fluid return conduit 44. The fluid return conduit 44 of the secondary fluid loop 40 may establish fluid communication between the turbine 63 of the portable energy generating unit 62 and the cooling towers 25 of the portable cooling tower unit 24 and between the cooling towers 25 and the fluid heat exchanger 41 of the portable heat exchanger unit 32. The distribution conduit 42 may be configured for releasable connection to the secondary fluid pump 68, and the fluid return conduit 44 for releasable connection to the turbine 63 and to the cooling towers 25 and the fluid heat exchanger 41, typically as will be hereinafter described. A secondary fluid supply 52 may be disposed in fluid communication with the fluid return conduit 44, as illustrated, the distribution conduit 42 and/or other conduit or component of the secondary fluid loop 40. The secondary fluid supply 52 may contain a reservoir or supply of the secondary fluid 55.

Referring next to FIGS. 4-15 of the drawings, in some embodiments, the portable control room unit 8, the portable cooling tower unit 24, the portable heat exchanger unit 32 and the portable energy generating unit 62 may each be rendered portable on a trailer 9. The trailer 9 may include an elongated trailer bed 10. The trailer bed 10 may be fitted with trailer wheels 11. A hitch coupling 13 of suitable design may be provided at a forward end of the trailer bed 10. The hitch coupling 13 may facilitate attachment of the trailer bed 10 to a towing vehicle 98 (FIGS. 12-15). At least one trailer leg 12 may extend or may be selectively extendable downwardly from the trailer bed 10 to support the trailer bed 10 on a support surface (not illustrated) when the trailer 9 is uncoupled from the towing vehicle 98. In some embodiments, the portable control room unit 8, the portable cooling tower unit 24, the portable heat exchanger unit 32 and the portable energy generating unit 62 may each be rendered portable on a flatbed truck. Accordingly, the towing vehicle 98 and the trailer bed 10 of the trailer 9 may be component parts of the flatbed truck.

Figure 4:
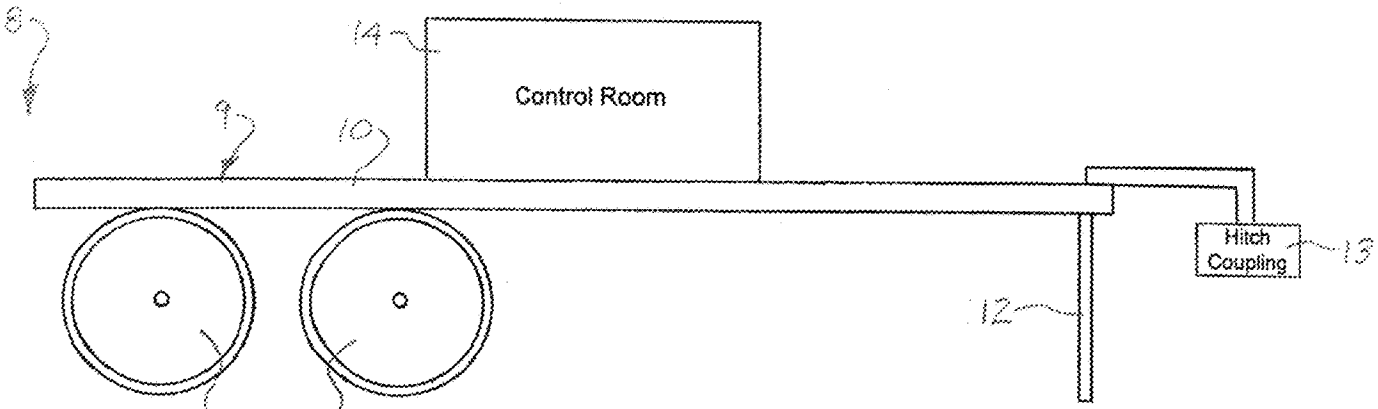
FIG. 4 is a side view block diagram of a typical portable control room unit of the system.
Figure 5:
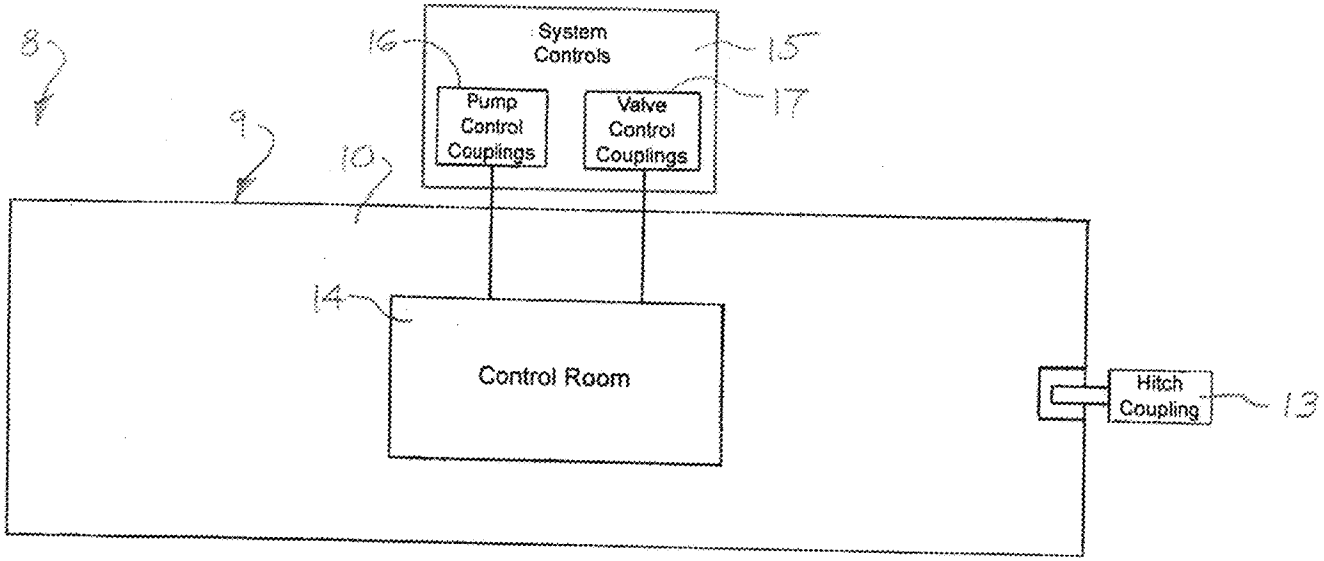
FIG. 5 is a top view block diagram of the portable control room unit of the system illustrated in FIG. 4.

As illustrated in FIGS. 4 and 5, the control room 14 may be supported by the trailer bed 10 on the trailer 9 of the portable control room unit 8. As illustrated in FIG. 5, the control room 14 may include system controls 15. The system controls 15 may include various controls for the valves and/or other components of the wellhead 30; the fluid heat exchanger 41, the primary fluid pump 46 and the secondary fluid pump 68 of the portable heat exchanger unit 32; the turbine 63 and the electrical generator 64 of the portable energy generating unit 62; the cooling towers 25 of the portable cooling tower unit 24; and/or other components of the system 1. As further illustrated in FIG. 5, the system controls 15 may include pump control couplings 16, valve control couplings 17, electrical control couplings (not illustrated) and/or other couplings which may be configured for releasable connection to the components of the system 1 typically according to the knowledge of those skilled in the art.

Figure 6:
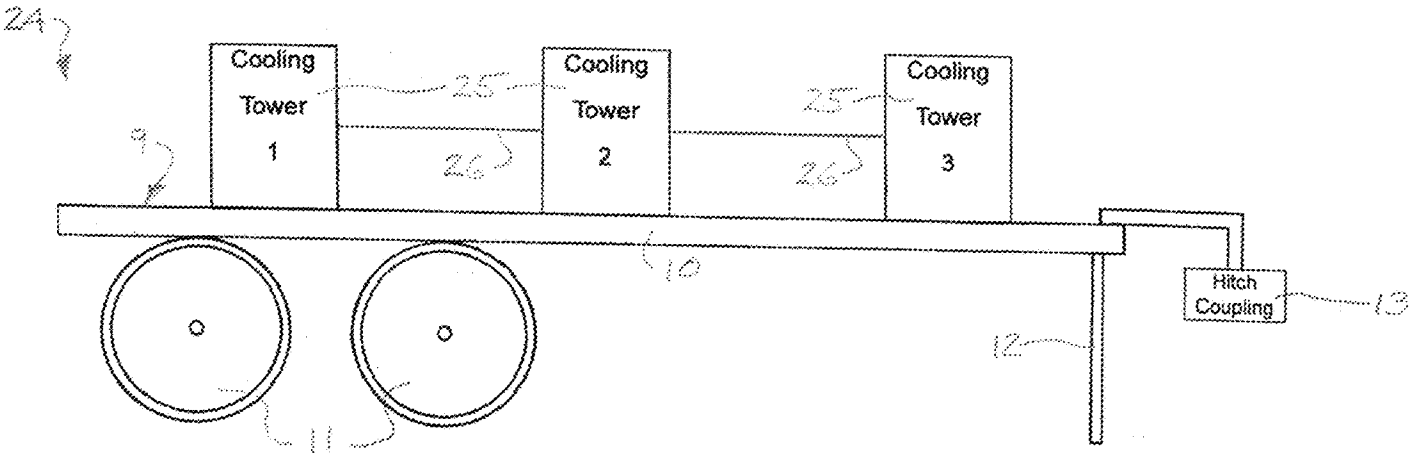
FIG. 6 is a side view block diagram of a typical portable cooling tower unit of the system.
Figure 7:
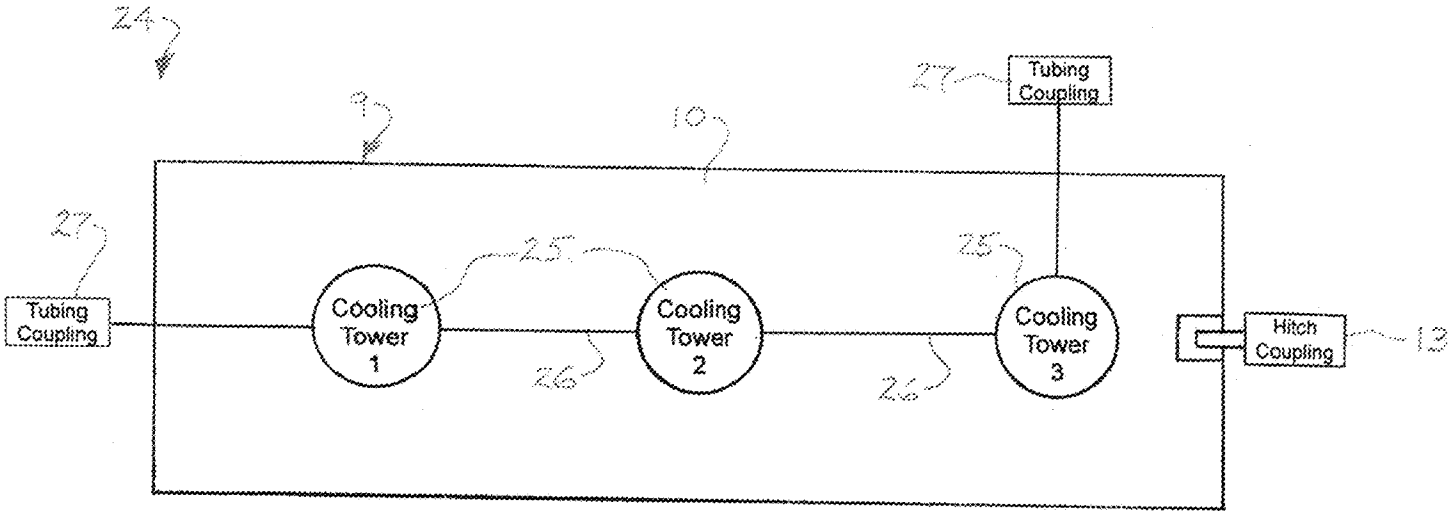
FIG. 7 is a top view block diagram of the portable cooling tower unit of the system illustrated in FIG. 6.

As illustrated in FIGS. 6 and 7, the cooling towers 25 may be supported by the trailer bed 10 on the trailer 9 of the portable cooling tower unit 24. In some embodiments, cooling tower conduits 26 may establish fluid communication between the multiple cooling towers 25. As illustrated in FIG. 7, tubing couplings 27 may facilitate releasable fluid coupling of the cooling towers 25 with the fluid return conduit 44 (FIGS. 1 and 3) of the secondary fluid loop 40.

Figure 8:
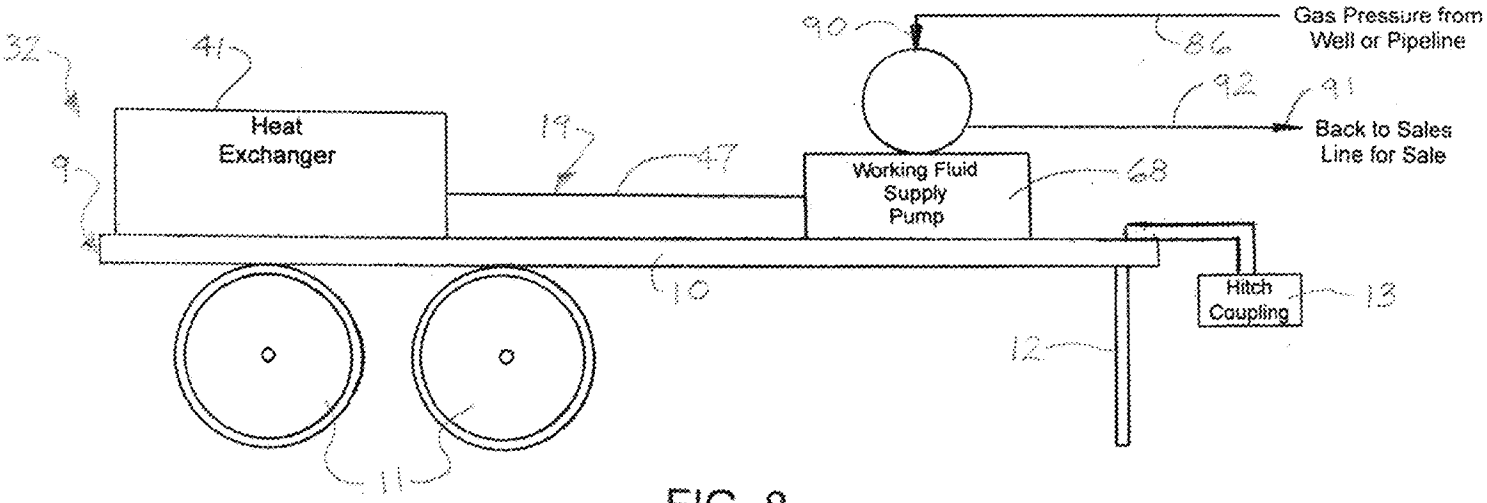
FIG. 8 is a side view block diagram of a typical portable heat exchanger unit of the system.
Figure 9:
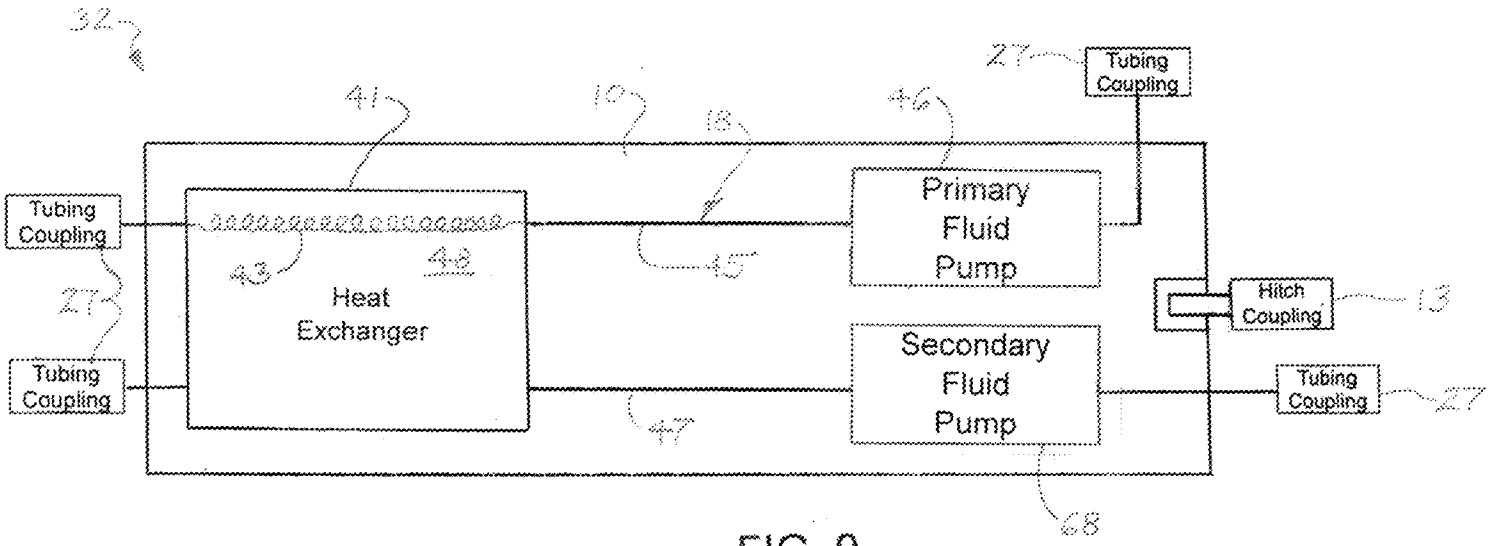
FIG. 9 is a top view block diagram of the portable heat exchanger unit of the system illustrated in FIG. 8.

As illustrated in FIGS. 8 and 9, the fluid heat exchanger 41, the primary fluid pump 46 and the secondary fluid pump 68 may be supported on the trailer 9 of the portable cooling tower unit 24. As illustrated in FIG. 9, the fluid heat exchanger 41 may include a heat-transmissible heat exchanger coil 43. The heat exchanger coil 43 may be configured to accommodate flow of the primary fluid 54 through the fluid heat exchanger 41. The fluid heat exchanger 41 may include a separate, secondary fluid flow path 48 which is disposed in thermal communication with the heat exchanger coil 43 and is configured to accommodate flow of the secondary fluid 55 through the fluid heat exchanger 41. In some embodiments, the fluid heat exchanger 41 may be configured to accommodate flow of the primary fluid 54 through the heat exchanger coil 43 and flow of the secondary fluid 55 through the secondary fluid flow path 48 in opposite directions, typically according to the knowledge of those skilled in the art.

A heat exchanger coil conduit 45 may establish fluid communication between an outlet of the heat exchanger coil 43 of the fluid heat exchanger 41 and an inlet of the primary fluid pump 46. A tubing coupling 27 may be disposed in fluid communication with the primary fluid pump 46. The tubing coupling 27 may facilitate releasable fluid connection of an outlet of the primary fluid pump 46 to the recirculation conduit 36 (FIGS. 1 and 2) of the primary fluid loop 34.

A heat exchanger outlet conduit 47 may establish fluid communication between an outlet of the fluid heat exchanger 41 and an inlet of the secondary fluid pump 68. A tubing coupling 27 may be disposed in fluid communication with the secondary fluid pump 68. The tubing coupling 27 may facilitate releasable fluid connection of an outlet of the secondary fluid pump 68 to the distribution conduit 42 (FIGS. 1 and 3) of the secondary fluid loop 40.

As further illustrated in FIG. 9, a tubing coupling 27 may be disposed in fluid communication with an inlet of the heat exchanger coil 43 of the fluid heat exchanger 41. The tubing coupling 27 may facilitate releasable fluid connection of the inlet of the heat exchanger coil 43 with the recirculation conduit 36 (FIGS. 1 and 2) of the primary fluid loop 34. A tubing coupling 27 may be disposed in fluid communication with an inlet of the fluid heat exchanger 41. The tubing coupling 27 may facilitate releasable fluid connection of the inlet of the fluid heat exchanger 41 with the fluid return conduit 44 (FIGS. 1 and 3) of the secondary fluid loop 40.

In some embodiments, the secondary fluid pump 68 may include an electric motor (not illustrated) which facilitates pumping of the secondary fluid 55 through the secondary fluid loop 40. As illustrated in FIG. 8, in some embodiments, the secondary fluid pump 68 may be configured such that the kinetic energy of the flowing inlet gas stream 90 of natural gas in a natural gas pipeline 86 may supplement or substitute for the electric motor to provide the pumping of the secondary fluid 55 through the secondary fluid loop 40. At the secondary fluid pump 68, the post-pump natural gas may be routed back to the natural gas pipeline 86, to the gas producing well and/or to a gas sale line 92 as a return gas stream 91. Accordingly, none of the natural gas is consumed or exhausted to the atmosphere. The inlet gas stream 90 may continue to flow from the natural gas pipeline 86 to the secondary fluid pump 68 for continued operation of the secondary fluid pump 68 and circulation of the secondary fluid 55 through the secondary fluid loop 40. Additionally or alternatively, the primary fluid pump 46 may be electric and/or may utilize the inlet gas stream 90 from the natural gas pipeline 86 and the return gas stream 91 subsequently routed through the gas sale line 92, typically as was heretofore described and illustrated with respect to the secondary fluid pump 68 in FIG. 8.

Figure 10:
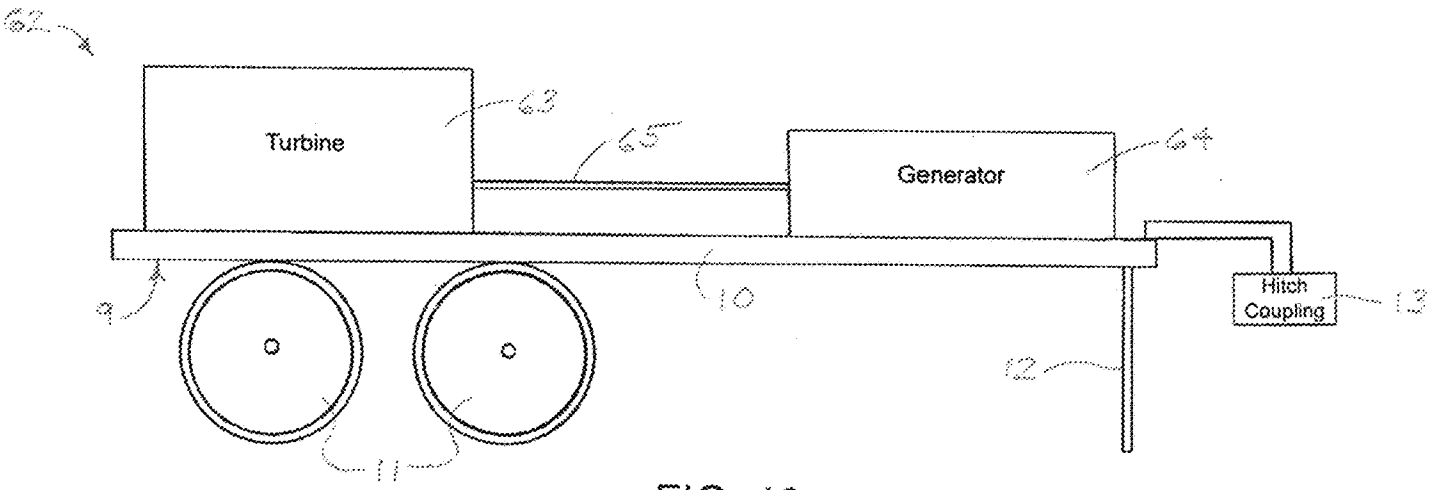
FIG. 10 is a side view block diagram of a typical portable energy generating unit of the system.
Figure 11:
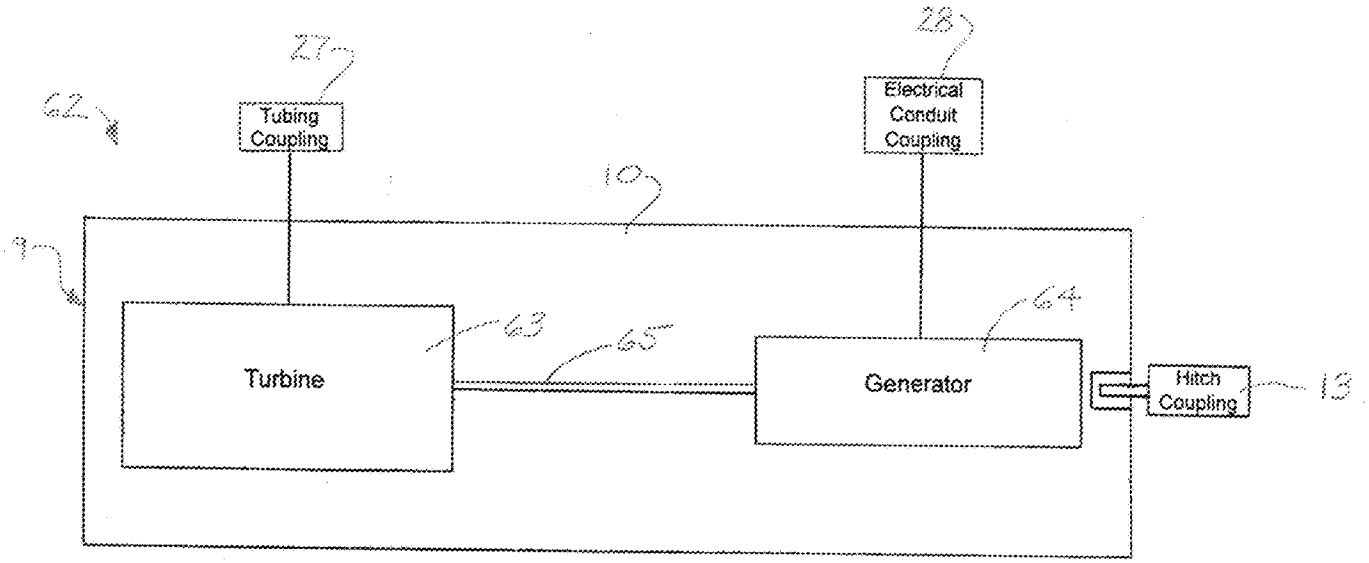
FIG. 11 is a top view block diagram of the portable energy generating unit of the system illustrated in FIG. 10.
Figure 12:
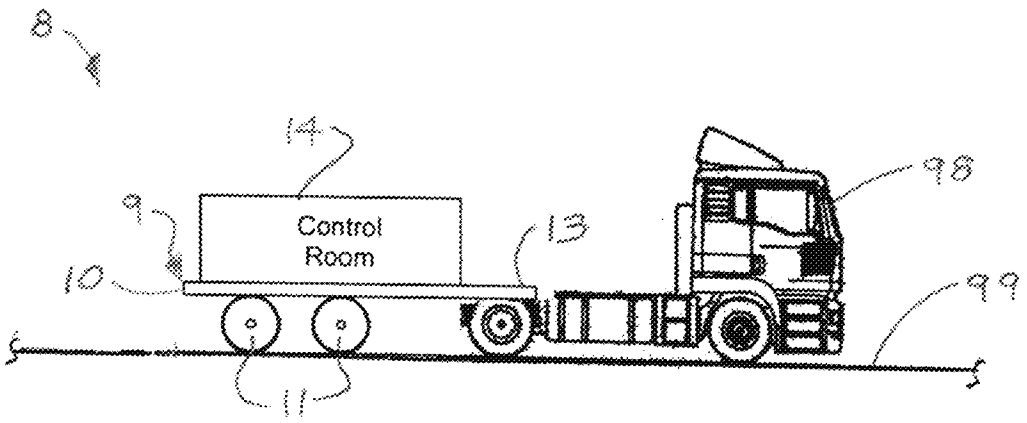
FIG. 12 is a side view of the trailered portable control room unit coupled to a towing vehicle in a typical first illustrative transport mode of the portable control room unit.
Figure 13:
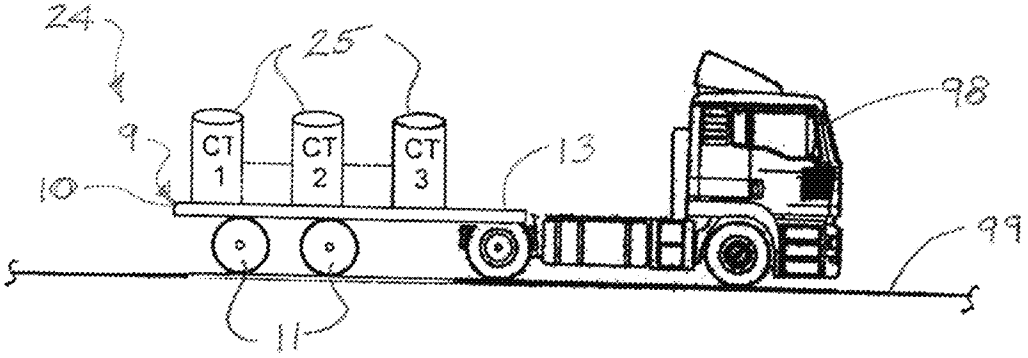
FIG. 13 is a side view of the trailered portable cooling tower unit coupled to a towing vehicle in the first illustrative transport mode of the portable cooling tower unit.
Figure 14:
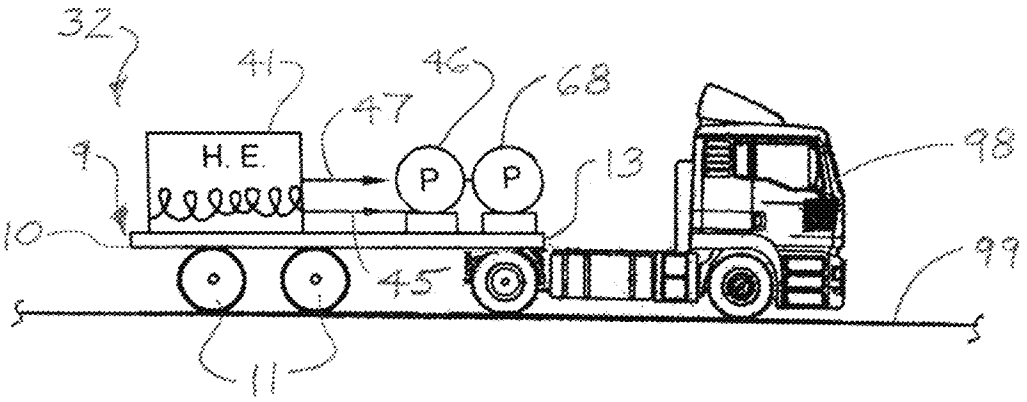
FIG. 14 is a side view of the trailered portable heat exchanger unit coupled to a towing vehicle in the first illustrative transport mode of the portable heat exchanger unit.
Figure 15:
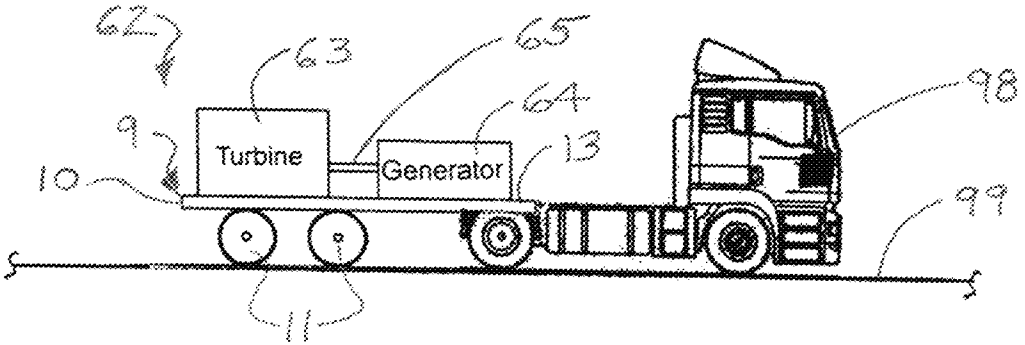
FIG. 15 a side view of the trailered portable energy generating unit coupled to a towing vehicle in the first illustrative transport mode of the portable energy generating unit.
Figure 17:
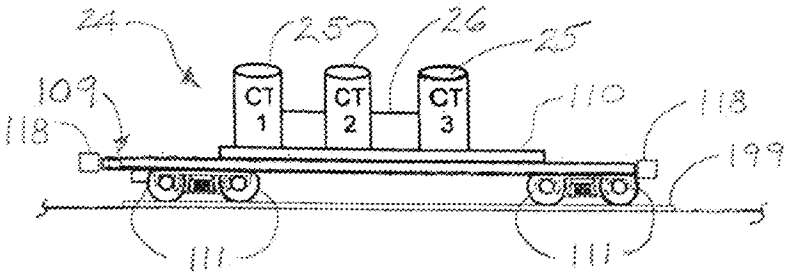
FIG. 17 is a side view of the portable cooling tower unit on a railroad flatcar in the second illustrative transport mode of the portable cooling tower unit.
Figure 16:
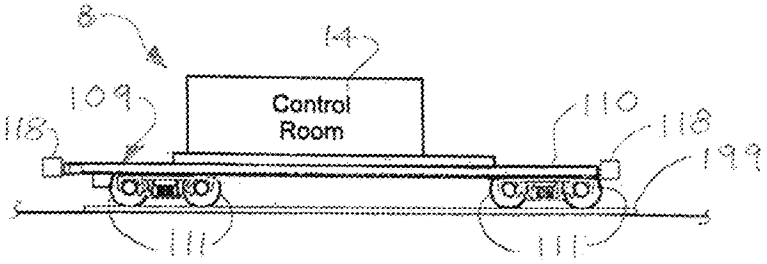
FIG. 16 is a side view of the portable control room unit on a railroad flatcar in a typical second illustrative transport mode of the portable energy generating unit.
Figure 19:
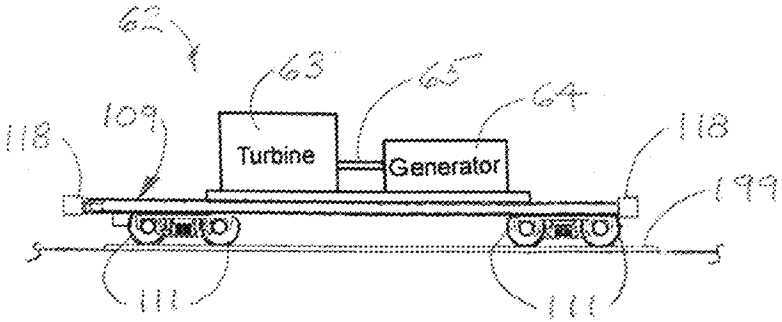
FIG. 19 is a side view of the portable energy generating unit on a railroad flatcar in the second illustrative transport mode of the portable energy generating unit.
Figure 18:
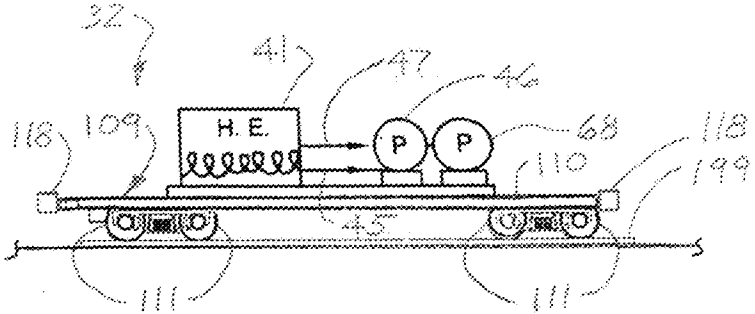
FIG. 18 is a side view of the portable heat exchanger unit on a railroad flatcar in the second illustrative transport mode of the portable heat exchanger unit.
Figure 21:
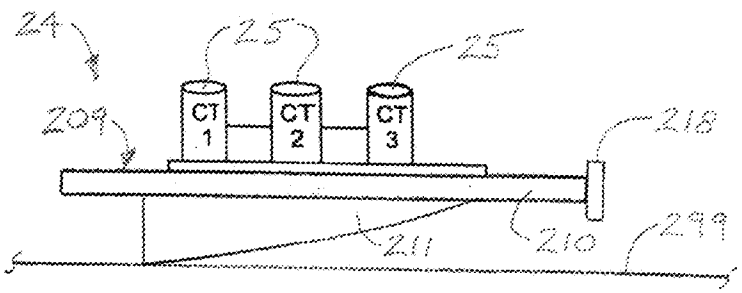
FIG. 21 is a side view of the portable cooling tower unit on a runner car in the third illustrative transport mode of the portable cooling tower unit.
Figure 20:
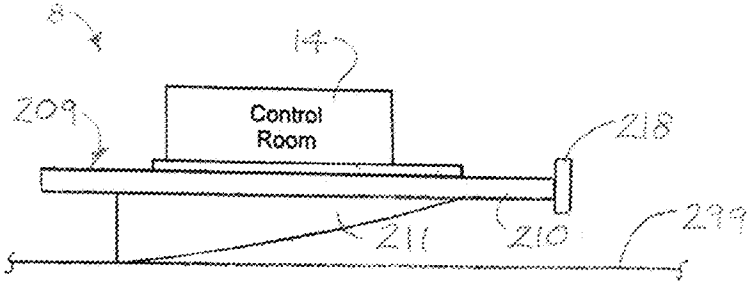
FIG. 20 is a side view of the portable control room unit on a runner car in a third illustrative transport mode of the portable control room unit.
Figure 23:
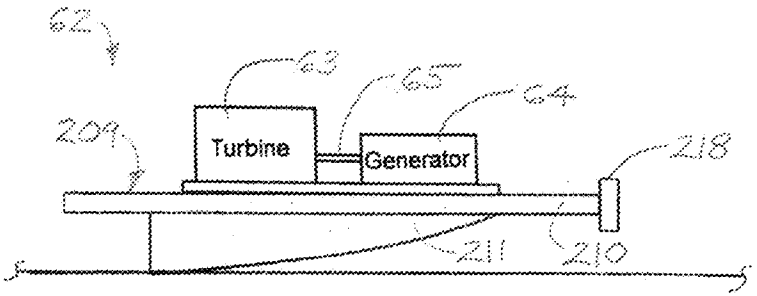
FIG. 23 is a side view of the portable energy generating unit on a runner car in the third illustrative transport mode of the portable energy generating unit.
Figure 22:
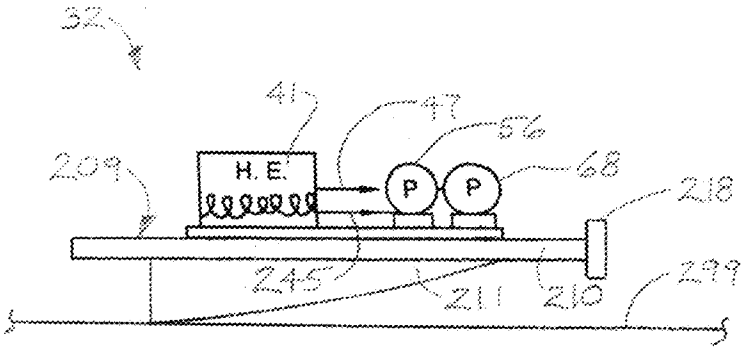
FIG. 22 is a side view of the portable heat exchanger unit on a runner car in the third illustrative transport mode of the portable heat exchanger unit.
Figure 24:
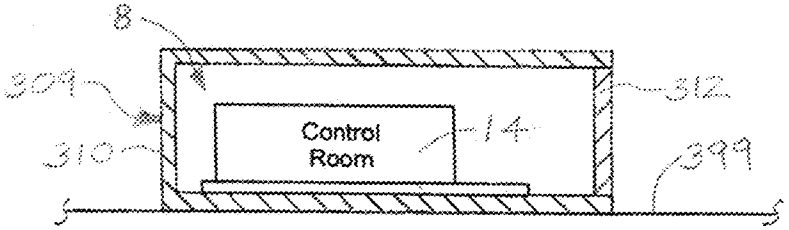
FIG. 24 is a side view of the portable control room unit in a cargo container (illustrated in section) in a fourth illustrative transport mode of the portable energy generating unit.
Figure 25:
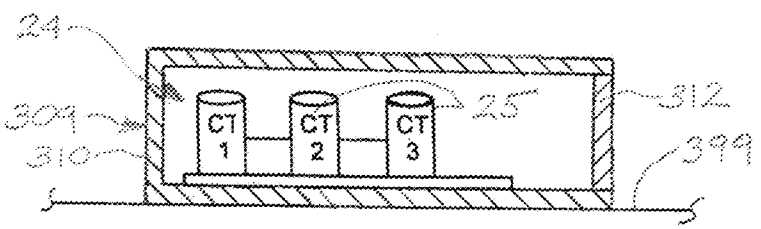
FIG. 25 is a side view of the portable cooling tower unit in a cargo container (illustrated in section) in the fourth illustrative transport mode of the portable cooling tower unit.
Figure 26:
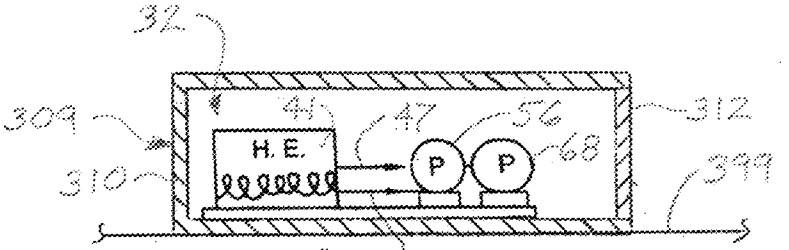
FIG. 26 is a side view of the portable heat exchanger unit in a cargo container (illustrated in section) in the fourth illustrative transport mode of the portable heat exchanger unit.
Figure 27:
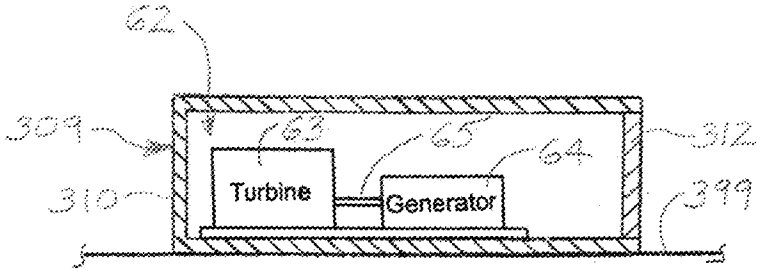
FIG. 27 is a side view of the portable energy generating unit in a cargo container (illustrated in section) in the fourth illustrative transport mode of the portable energy generating unit.

As illustrated in FIGS. 10 and 11, the turbine 63 and the electrical generator 64 may be supported by the trailer bed 10 on the trailer 9 of the portable energy generating unit 62. As illustrated in FIG. 11, a tubing coupling 27 may facilitate releasable fluid coupling of the turbine 63 with the fluid return conduit 44 (FIGS. 1 and 3) of the secondary fluid loop 40. An electrical conduit coupling 28 may facilitate electrical connection to an appliance, system, storage facility and/or other outlet (not illustrated) which uses the electrical power generated by the electrical generator 64.

Referring next to FIGS. 12-15, in typical transportation of the portable system units, the trailer 9 of each of the portable control room unit 8 (FIG. 12), the portable cooling tower unit 24 (FIG. 13), the portable heat exchanger unit 32 (FIG. 14) and the portable energy generating unit 62 (FIG. 15) may be coupled to a corresponding towing vehicle 98. In some applications, this may be accomplished by connecting the hitch coupling 13 on the trailer bed 10 of the trailer 9 with a companion hitch coupling receiver (not illustrated) on the towing vehicle 98. The particular type of hitch coupling 13 on the trailer bed 10 of the trailer 9 may depend on the type of towing vehicle 98 as well as the type of hitch coupling receiver on the towing vehicle 98. The towing vehicle 98 may be operated to tow the trailer 9 on a road, street, highway, interstate and/or other towing surface 99 in transportation of the portable control room unit 8, the portable cooling tower unit 24, the portable heat exchanger unit 32 and the portable energy generating unit 62 from a storage facility or location or from another geothermal well 18 to the geothermal well 18 (FIGS. 1 and 2) at which the system 1 will be assembled and operated.

In typical application of the system 1, the geothermal well 18 may be installed in the geothermal formation 22. In some applications, the geothermal well 18 may be an existing depleted oil or gas well. Accordingly, perforations (not illustrated) in the well casing wall 3 of the well casing 2 and the distal casing end 6 of the well casing 2 may be closed or sealed off typically according to the knowledge of those skilled in the art to fluidly seal the well casing 2 and the fluid flow conduit 76 from the geothermal formation 22. In other applications, the geothermal well 18 may be a dedicated geothermal well which is drilled and fitted or equipped for the express purpose of geothermal energy harvesting. Accordingly, the well casing wall 3 and the distal casing end 6 of the well casing 2 may be closed and fluidly sealed with respect to the geothermal formation 22. The temperature of the geothermal formation 22 may depend on various factors such as the location, depth and geological content and density. A typical temperature range of the geothermal formation 22 at depths of about 760 to 4,880 meters (2,500 to 16,000 feet) may include temperatures between about 65° C. and about 150° C. (150° F. and 300° F.). Completion of the geothermal well 18 may conclude with installation of the wellhead 30 at the proximal casing end 5 of the well casing wall 3 and the proximal conduit end 78 of the fluid flow conduit 76.

The portable control room unit 8, the portable cooling tower unit 24, the portable heat exchanger unit 32 and the portable energy generating unit 62 may be transported to the geothermal well 18. In some applications, this may be accomplished by coupling the trailer 9 which supports the corresponding portable control room unit 8, portable cooling tower unit 24, portable heat exchanger unit 32 and portable energy generating unit 62 to the towing vehicle 98, typically as was heretofore described with respect to FIGS. 12-15. The towing vehicle 98 may be operated to tow each trailer 9 on the towing surface 99 to the site of the geothermal well 18. At the site of the geothermal well 18, the trailer 9 may be uncoupled from the towing vehicle 98 and the portable control room unit 8, the portable cooling tower unit 24, the portable heat exchanger unit 32 and the portable energy generating unit 62 suitably positioned for assembly of the primary fluid loop 34 and the secondary fluid loop 40. Alternatively, each trailer 9 may remain coupled to each corresponding towing vehicle 98 throughout operation of the system 1.

As illustrated in FIGS. 1 and 2, the primary fluid loop 34 may be assembled by releasably connecting the recirculation conduit 36 to the primary fluid pump 46 and to the heat exchanger coil 43 in the fluid heat exchanger 41 of the portable heat exchanger unit 32, typically as was heretofore described with respect to FIG. 9, and to the wellhead 30 of the geothermal well 18. As illustrated in FIGS. 1 and 3, the secondary fluid loop 40 may be assembled by releasably connecting the distribution conduit 42 to the secondary fluid pump 68 of the portable heat exchanger unit 32 and to the turbine 63 of the portable energy generating unit 62 and by releasably connecting the fluid return conduit 44 to the turbine 63 and to the cooling towers 25 of the portable cooling tower unit 24 and to the fluid heat exchanger 41 of the portable heat exchanger unit 32, typically as was heretofore described with respect to FIG. 9. The control room 14 of the control room unit 8 may be releasably connected to the various pump controls, valve controls, electrical controls and/or other components of the system 1 typically via the pump control couplings 16 (FIG. 5), valve control couplings 17, electrical control couplings (not illustrated) and/or other couplings which may be necessary for operation of the system 1.

The system 1 may be implemented, typically from the control room 14, to harvest native thermal energy from the subterranean geothermal formation 22 to heat the primary fluid 54 to a selected target temperature. Accordingly, the primary fluid pump 46 of the portable heat exchanger unit 32 may be operated to circulate the primary fluid 54 from the primary fluid supply 51 in a continuous circuit through the heat exchanger coil 43 of the fluid heat exchanger 41, the heat exchanger coil conduit 45, the recirculation conduit 36, the wellhead 30 and into the geothermal well 18 through the well annulus 80, the fluid flow conduit 76, the wellhead 30, the recirculation conduit 36 and back through the heat exchanger coil 43 of the fluid heat exchanger 41, respectively. Alternatively, the primary fluid 54 may be pumped into the geothermal well 18 through the fluid flow conduit 76 and from the geothermal well 18 through the well annulus 80. As it flows through the geothermal well 18, thermal energy may be transferred typically by conduction through the well casing wall 3 of the well casing 2 to the primary fluid 54. The thermal energy-loaded primary fluid 54 may exit the wellhead 30 of the geothermal well 18 and enter the heat exchanger coil 43 of the fluid heat exchanger 41 through the recirculation conduit 36. The thermally exhausted primary fluid 54 may be repeatdly returned from the fluid heat exchanger 41 to the geothermal well 18, typically through the recirculation conduit 36, for another cycle through the geothermal well 18 and the primary fluid loop 34 in a continuous and repeating circuit.

As the primary fluid pump 46 pumps the primary fluid 54 through the primary fluid loop 34, the secondary fluid pump 68 of the portable heat exchanger unit 32 may be operated to circulate the secondary fluid 55 from the secondary fluid supply 52 in a continuous circuit through the secondary fluid flow path 48 (FIG. 9) in the fluid heat exchanger 41, the heat exchanger outlet conduit 47, the distribution conduit 42, the turbine 63 of the portable energy generating unit 62, the fluid return conduit 44, the cooling towers 25 of the portable cooling tower unit 24, the wellhead 30 and back through the fluid heat exchanger 41, respectively. At the cooling towers 25, the secondary fluid 55 may be condensed from the vapor state to the liquid state typically for pumping efficiency purposes. In some applications, the fluid return conduit 44 may bypass the wellhead 30 and traverse directly from the cooling towers 25 back to the fluid heat exchanger 41.

As the heated primary fluid 54 flows through the heat exchanger coil 43 of the fluid heat exchanger 41 and the secondary fluid 55 simultaneously flows through the secondary fluid flow path 48 in the fluid heat exchanger 41 in thermal contact with the heat exchanger coil 43, the harvested thermal energy in the heated primary fluid 54 may be transferred to the secondary fluid 55 typically by conduction through the heat exchanger coil 43 and by convection throughout the secondary fluid 55. The transferred thermal energy in the secondary fluid 55 may be harvested at the turbine 63 to drive the turbine 63. In turn, the turbine 63 may drive the electrical generator 64 through the electrical generator coupling 65. Electrical power generated by the electrical generator 64 may be used in any of a variety of applications such as for heating, cooling, hydrogen production, and/or other purposes. Accordingly, the primary fluid loop 34 and the secondary fluid loop 40 may form separate closed loops which may thermally interface with each other at the fluid heat exchanger 41 to transfer thermal energy from the primary fluid 54 to the secondary fluid 55 and utilize the thermal energy in the secondary fluid 55 to perform work, typically by generation of electrical power by operation of the turbine 63 and the electrical generator 64.

Use of the system 1 may be concluded by terminating operation of the primary fluid pump 46 and flow of the primary fluid 54 through the primary fluid loop 34 and by terminating operation of the secondary fluid pump 68 and flow of the secondary fluid 55 through the secondary fluid loop 40. The fluid heat exchanger 41 and the primary fluid pump 46 of the portable heat exchanger unit 32 may be disconnected or uncoupled from the primary fluid loop 34 and the fluid heat exchanger 41 and the secondary fluid pump 68 disconnected or uncoupled from the secondary fluid loop 40. Likewise, the cooling towers 25 of the portable cooling tower unit 24 and the turbine 63 of the portable energy generating unit 62 may be disconnected or uncoupled from the secondary fluid loop 40. The control room 14 of the control room unit 8 may be disconnected from the various components of the system 1. The trailer 9 of each corresponding portable control room unit 8, portable cooling tower unit 24, portable heat exchanger unit 32 and portable energy generating unit 62 may be hitched to its corresponding towing vehicle 98 (FIGS. 12-15). The portable control room unit 8, portable cooling tower unit 24, portable heat exchanger unit 32 and portable energy generating unit 62 may subsequently be towed to a storage site or facility or alternatively, to the site of another geothermal well 18 and deployed in place to assemble the system 1, which may be operated as was heretofore described.

In some applications, after disconnection of the portable control room unit 8, the portable cooling tower unit 24, the portable heat exchanger unit 32 and the portable energy generating unit 62 from the geothermal well 18, a renewable geothermal energy harvesting system (not illustrated) may be permanently installed at the geothermal well 18. The renewable geothermal energy harvesting system may have a design which is the same as or similar to those described in U.S. application Ser. No. 18/075,120, filed Dec. 5, 2022, which application is hereby incorporated by reference herein in its entirety for all purposes.

Referring next to FIGS. 16-19 of the drawings, in some embodiments, the portable control room unit 8 (FIG. 16), the portable cooling tower unit 24 (FIG. 17), the portable heat exchanger unit 32 (FIG. 18) and/or the portable energy generating unit 62 (FIG. 19) may be rendered portable on a railroad flatcar 109. Each railroad flatcar 109 may have an elongated flatcar bed 110 fitted with railroad wheels 111 and front and rear railcar hitches 118. The railroad wheels 111 of each railroad flatcar 109 may be configured to traverse the adjacent railroad rails 119 of a railroad. The portable control room unit 8, portable cooling tower unit 24, portable heat exchanger unit and portable energy generating unit 62 may be transported to the site of the geothermal well 18 (FIGS. 1 and 2) typically as each railroad flatcar 109 is pulled by a locomotive in a train with other railcars (not illustrated). The railroad flatcars 109 may be used alone or in combination with the trailers 9 which were heretofore described with respect to FIGS. 12-15, as needed typically depending on the terrain which needs to be traversed and/or the route which needs to be taken to transport the portable control room unit 8, portable cooling tower unit 24, portable heat exchanger unit and portable energy generating unit 62 to the site of the geothermal well 18.

Referring next to FIGS. 20-23 of the drawings, in some embodiments, the portable control room unit 8 (FIG. 20), the portable cooling tower unit 24 (FIG. 21), the portable heat exchanger unit 32 (FIG. 22) and/or the portable energy generating unit 62 (FIG. 23) may be rendered portable on a runner car 209. Each runner car 209 may have an elongated runner car bed 210 fitted with at least two parallel, spaced-apart runners 211 (one of which is shown) and a runner car bed hitch 218. The runners 211 of each runner car 209 may be configured to traverse snowy, sandy or like terrain 219. The portable control room unit 8, portable cooling tower unit 24, portable heat exchanger unit and portable energy generating unit 62 may be transported to the site of the geothermal well 18 (FIGS. 1 and 2) typically as each runner car 209 is towed by a suitable towing vehicle (not illustrated). The runner cars 209 may be used alone or in combination with the trailers 9 which were heretofore described with respect to FIGS. 12-15 and/or the railroad flatcars 109 heretofore described with respect to FIGS. 16-19, as needed typically depending on the terrain which needs to be traversed and/or the route which needs to be taken to transport the portable control room unit 8, portable cooling tower unit 24, portable heat exchanger unit and portable energy generating unit 62 to the site of the geothermal well 18. In some embodiments, the portable control room unit 8, the portable cooling tower unit 24, the portable heat exchanger unit 32 and the portable energy generating unit 62 may each be rendered portable on a flatbed runner car in which case the towing vehicle and the runner car bed 210 may be component parts of the runner car 209.

Referring next to FIGS. 24-27 of the drawings, in some embodiments, the portable control room unit 8 (FIG. 20), the portable cooling tower unit 24 (FIG. 21), the portable heat exchanger unit 32 (FIG. 22) and/or the portable energy generating unit 62 (FIG. 23) may be rendered portable in a cargo container 309. Each cargo container 309 may have a container enclosure 310 fitted with a container door 312. Each cargo container 309 may be suitably sized and configured to rest on a carrying vehicle 399 such as a ship, railroad, trailer, flatbed truck or the like. The portable control room unit 8, portable cooling tower unit 24, portable heat exchanger unit and portable energy generating unit 62 may be transported to the site of the geothermal well 18 (FIGS. 1 and 2) typically as each cargo container 309 is carried on the carrying vehicle 399. The carrying vehicles 309 may be used alone or in combination with the trailers 9 which were heretofore described with respect to FIGS. 12-15, the railroad flatcars 109 heretofore described with respect to FIGS. 16-19 and/or the runner cars 209 heretofore described with respect to FIGS. 20-23, as needed depending on the terrain which needs to be traversed and/or the route which needs to be taken to transport the portable control room unit 8, portable cooling tower unit 24, portable heat exchanger unit and portable energy generating unit 62 to the site of the geothermal well 18.

Figure 28:
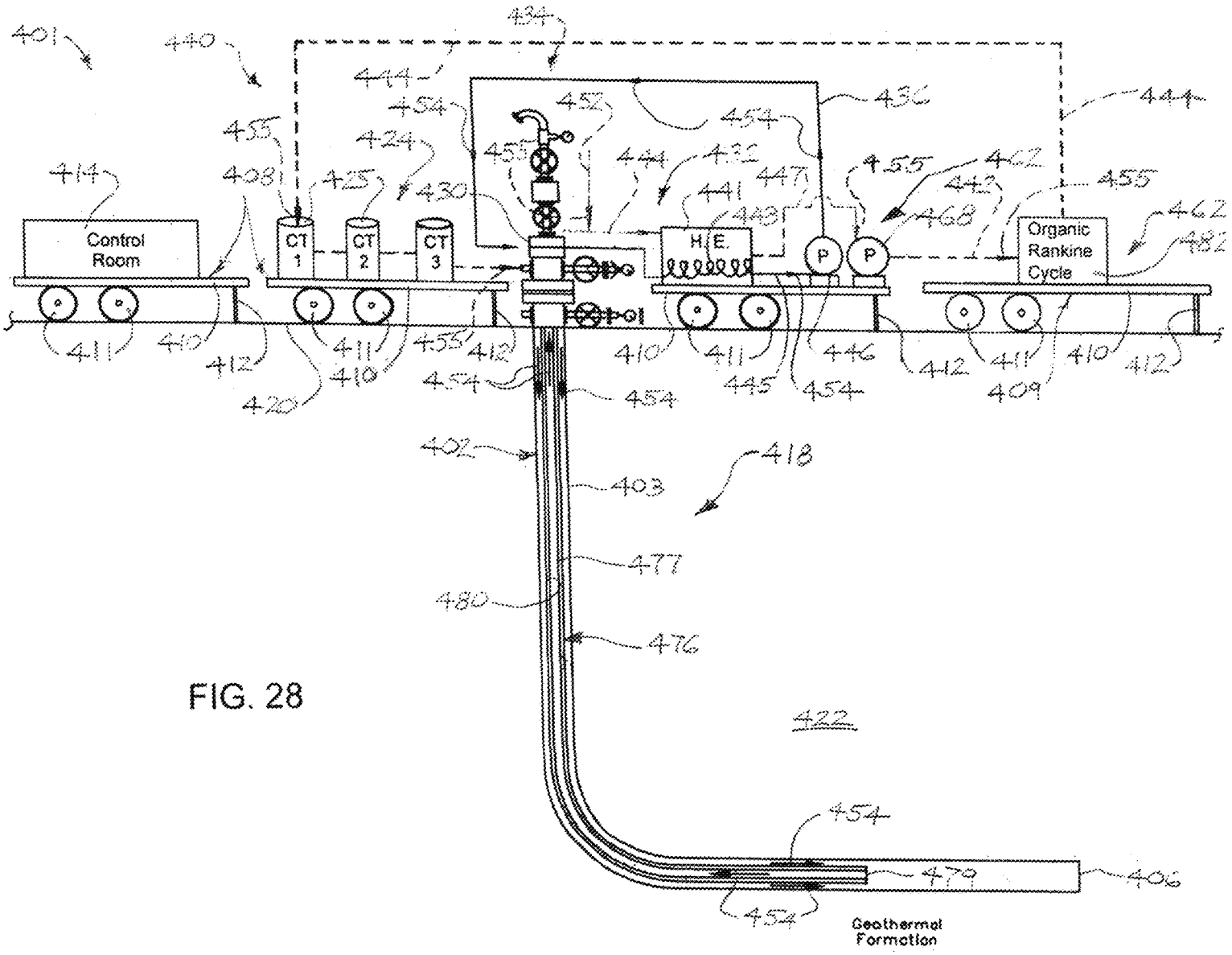
FIG. 28 is a sectioned view of a subterranean geothermal well with an alternative illustrative embodiment of the portable renewable geothermal energy harvesting systems deployed in place at the geothermal well to provide geothermal energy for a portable Organic Rankine Cycle (ORC) according to some applications of the system.

Referring next to FIG. 28 of the drawings, an alternative illustrative embodiment of the portable renewable geothermal energy harvesting systems is generally indicated by reference numeral 401. Unless otherwise indicated, elements of the system 401 which are structurally and/or functionally analogous to the respective elements of the system 1 that was heretofore described with respect to FIGS. 1-27 are designated by the same respective reference numerals in the 401-499 series in FIG. 28. Accordingly, to the extent which is applicable, the same description which was heretofore described with respect to the system 1 is incorporated by reference herein in its entirety herein with respect to the system 401.

The portable energy generating unit 462 of the system 401 may include at least one Organic Rankine Cycle (ORC) 482. In some embodiments, at least some components of the ORC 482 may be rendered portable on a trailer 409, typically as was heretofore described with respect to the system 1. Alternatively, at least some components of the ORC 482 may be rendered portable on a railroad flatcar 109 (FIGS. 16-19); a runner car 209 (FIGS. 20-23); or contained in a cargo container 309 (FIGS. 24-27). In some embodiments, the ORC 482 may have a design which is the same as or similar to that disclosed in U.S. application Ser. No. 18/075,120, filed Dec. 5, 2022, and incorporated by reference herein in its entirety. In the system 401, the secondary fluid pump 468 of the portable control room unit 408 may be disposed in fluid communication with the ORC 482 typically through the distribution conduit 442. The fluid return conduit 444 may be disposed in fluid communication with the ORC 482. Accordingly, the secondary fluid loop 440 of the system 401 may include the fluid heat exchanger 441 and the secondary fluid pump 468 of the portable heat exchanger unit 432, the ORC 482 of the portable energy generating unit 462, the fluid return conduit 444, the cooling towers 425 of the portable cooling tower unit 424, and optionally, the wellhead 430 of the geothermal well 418. In some embodiments, the portable energy generating unit 462 may include at least some components of any thermal application system which is disclosed in U.S. application Ser. No. 18/075,120.

Application of the system 401 may be as was heretofore described with respect to the system 1. The secondary fluid pump 468 may pump the heated secondary fluid 455 from the fluid heat exchanger 441 through the heat exchanger outlet conduit 447 and the distribution conduit 442 to the ORC 482. At the ORC 482, the thermal energy may be harvested from the secondary fluid 455 and used typically to generate hydrogen via an electrolyzer and/or electrical power via an electrical generator.

Figure 29:
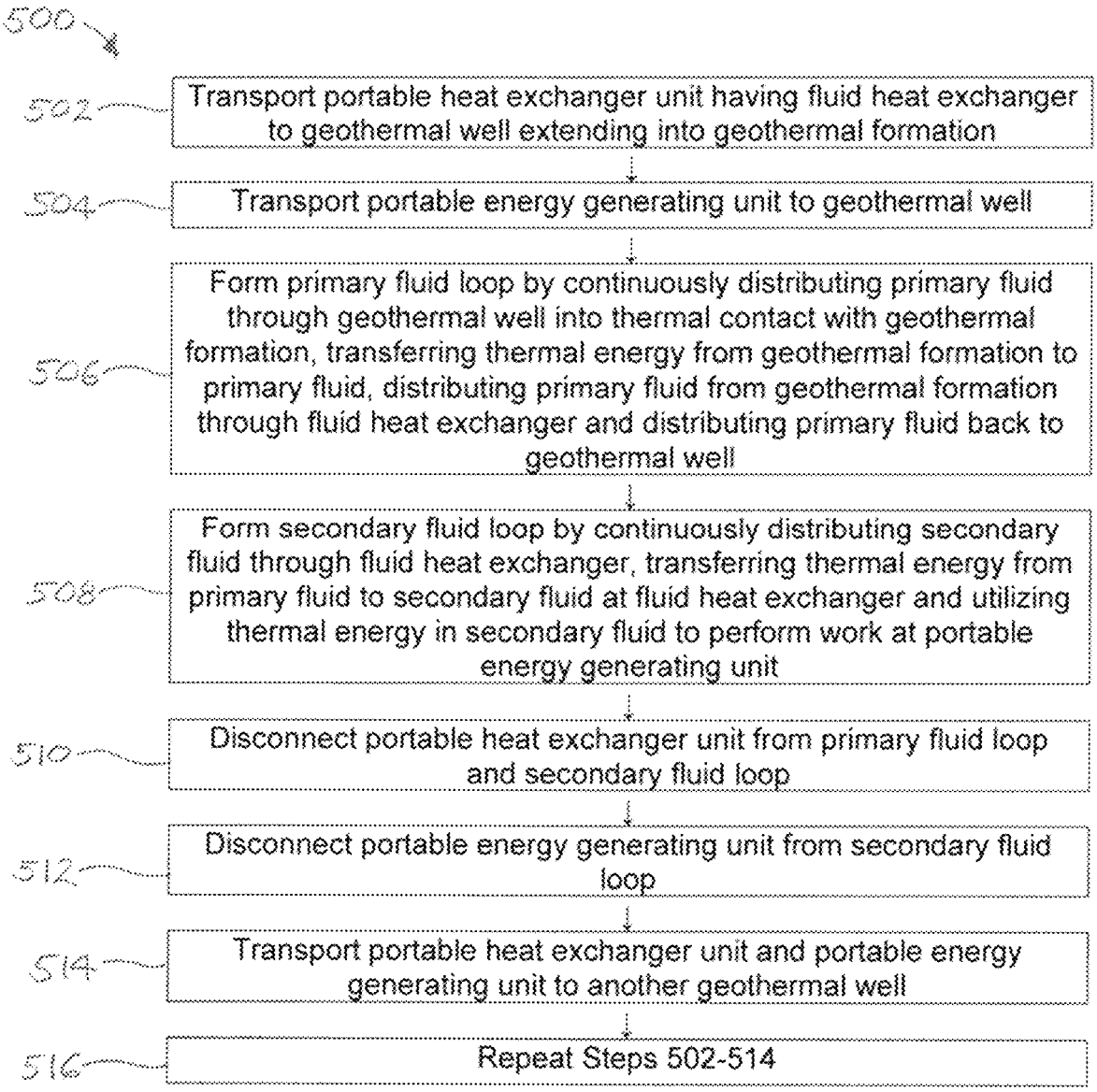
FIG. 29 is a flow diagram of an illustrative embodiment of the portable renewable geothermal energy harvesting methods.

Referring next to FIG. 29 of the drawings, a flow diagram of an illustrative embodiment of the portable renewable geothermal energy harvesting methods is generally indicated by reference number 500. At Step 502, at least one portable heat exchanger unit having at least one fluid heat exchanger may be transported to a geothermal well which extends into a geothermal formation.

At Step 504, at least one portable energy generating unit may be transported to the geothermal well.

At Step 506, at least one primary fluid loop may be formed by continuously distributing primary fluid through the geothermal well into thermal contact with the geothermal formation, transferring thermal energy from the geothermal formation to a primary fluid, distributing the primary fluid from the geothermal formation through the fluid heat exchanger and distributing the primary fluid back to the geothermal well.

At Step 508, at least one secondary fluid loop may be formed by continuously distributing a secondary fluid through a fluid heat exchanger, transferring the thermal energy from the primary fluid to the secondary fluid at the fluid heat exchanger and utilizing the thermal energy in the secondary fluid to perform work at the portable energy generating unit.

At Step 510, upon conclusion of system operation, the portable heat exchanger unit may be disconnected from the primary fluid loop and the secondary fluid loop.

At Step 512, the portable energy generating unit may be disconnected from the secondary fluid loop.

At Step 514, the portable heat exchanger unit and the portable energy generating unit may be transported to a storage facility or site or to another geothermal well.

At Step 516, Steps 502-514 may be repeated at the other geothermal well.

While certain illustrative embodiments of the disclosure have been described above, it will be recognized and understood that various modifications can be made to the embodiments and the appended claims are intended to cover all such modifications which may fall within the spirit and scope of the disclosure.

I claim:

1. A renewable geothermal energy harvesting method, comprising:

step A: transporting a portable heat exchanger unit having a fluid heat exchanger to a geothermal well extending into a geothermal formation;

step B: transporting a portable energy generating unit to the geothermal well;

step C: forming a primary fluid loop by continuously performing steps C1-C4:

step C1: distributing a primary fluid through the geothermal well into thermal contact with the geothermal formation;

step C2: transferring thermal energy from the geothermal formation to the primary fluid;

step C3: distributing the primary fluid from the geothermal formation through the fluid heat exchanger; and step C4: distributing the primary fluid back to the geothermal well;

step D: forming a secondary fluid loop by performing steps D1-D3:

step D1: continuously distributing a secondary fluid through the fluid heat exchanger;

step D2: transferring thermal energy from the primary fluid to the secondary fluid at the fluid heat exchanger; and step D3: utilizing the thermal energy in the secondary fluid to perform work at the portable energy generating unit;

step E: disconnecting the portable heat exchanger unit from the primary fluid loop and the secondary fluid loop;

step F: disconnecting the portable energy generating unit from the secondary fluid loop;

step G: transporting the portable heat exchanger unit and the portable energy generating unit to another geothermal well; and step H: repeating steps A-G.

2. The method of claim 1, wherein the transporting the portable energy generating unit to the geothermal well comprises transporting a turbine and an electrical generator coupled to the turbine to the geothermal well, and wherein the utilizing the thermal energy in the secondary fluid to perform work at the portable energy generating unit comprises generating electrical power by using the thermal energy in the secondary fluid to drive the turbine and using the turbine to drive the electrical generator.

3. The method of claim 1, wherein the transporting the portable heat exchanger unit to the geothermal well comprises transporting the portable heat exchanger unit on a trailer, a railroad flatcar, a runner car, or in a cargo container.

4. The method of claim 1, wherein the transporting the portable energy generating unit to the geothermal well comprises transporting the portable energy generating unit to the geothermal well on a trailer, a railroad flatcar, a runner car, or in a cargo container.

5. The method of claim 1, comprising transporting a portable control room unit having a control room to the geothermal well and controlling the fluid heat exchanger and the portable energy generating unit from the control room.

6. The method of claim 5, wherein the transporting the portable control room unit to the geothermal well comprises transporting the portable control room unit to the geothermal well on a trailer, a railroad flatcar, a runner car, or in a cargo container.

7. The method of claim 1, comprising transporting a portable cooling tower unit having at least one cooling tower to the geothermal well and wherein the forming the secondary fluid loop comprises continuously distributing the secondary fluid from the fluid heat exchanger through the at least one cooling tower and back to the fluid heat exchanger.

8. The method of claim 7, wherein the transporting the portable cooling tower unit to the geothermal well comprises transporting the portable cooling tower unit on a trailer, a railroad flatcar, a runner car, or in a cargo container.

9. A renewable geothermal energy harvesting method, comprising:

step A: transporting a portable heat exchanger unit having a fluid heat exchanger to a geothermal well extending into a geothermal formation, the geothermal well having a horizontal well casing fluidly separated from the geothermal formation and a fluid flow conduit disposed in and fluidly communicating with the well casing;

step B: transporting a portable energy generating unit to the geothermal well;

step C: forming a primary fluid loop by continuously performing steps C1-C5:

step C1: distributing a primary fluid through a first one of the well casing and the fluid flow conduit of the geothermal well into thermal contact with the geothermal formation;

step C2: transferring thermal energy from the geothermal formation to the primary fluid;

step C3: distributing the primary fluid from the geothermal formation through a second one of the well casing and the fluid flow conduit of the geothermal well;

step C4: distributing the primary fluid through the fluid heat exchanger; and step C5: distributing the primary fluid from the fluid heat exchanger through the geothermal well into thermal contact with the geothermal formation;

step D: forming a secondary fluid loop by performing steps D1-D3:

step D1: continuously distributing a secondary fluid through the fluid heat exchanger;

step D2: transferring thermal energy from the primary fluid to the secondary fluid at the fluid heat exchanger; and step D3: utilizing the thermal energy in the secondary fluid to perform work at the portable energy generating unit;

step E: disconnecting the portable heat exchanger unit from the primary fluid loop and the secondary fluid loop;

step F: disconnecting the portable energy generating unit from the secondary fluid loop;

step G: transporting the portable heat exchanger unit and the portable energy generating unit to another geothermal well; and step H: repeating steps A-G.

10. The method of claim 9, wherein the transporting the portable energy generating unit to the geothermal well comprises transporting a turbine and an electrical generator coupled to the turbine to the geothermal well, and wherein the utilizing the thermal energy in the secondary fluid to perform work at the portable energy generating unit comprises generating electrical power by using the thermal energy in the secondary fluid to drive the turbine and using the turbine to drive the electrical generator.

11. The method of claim 9, wherein the transporting the portable heat exchanger unit to the geothermal well comprises transporting the portable heat exchanger unit on a trailer, a railroad flatcar, a runner car, or in a cargo container.

12. The method of claim 9, wherein the transporting the portable energy generating unit to the geothermal well comprises transporting the portable energy generating unit to the geothermal well on a trailer, a railroad flatcar, a runner car, or in a cargo container.

13. The method of claim 9, comprising transporting a portable control room unit having a control room to the geothermal well and controlling the fluid heat exchanger and the portable energy generating unit from the control room.

14. The method of claim 13, wherein the transporting the portable control room unit to the geothermal well comprises transporting the portable control room unit to the geothermal well on a trailer, a railroad flatcar, a runner car, or in a cargo container.

15. The method of claim 9, comprising transporting a portable cooling tower unit having at least one cooling tower to the geothermal well and wherein the continuously distributing the secondary fluid through the fluid heat exchanger comprises continuously distributing the secondary fluid from the fluid heat exchanger through the at least one cooling tower and back to the fluid heat exchanger.

16. The method of claim 15, wherein the transporting the portable cooling tower unit to the geothermal well comprises transporting the portable cooling tower unit on a trailer, a railroad flatcar, a runner car, or in a cargo container.

17. A portable renewable geothermal energy system, comprising:

a subterranean geothermal well disposed in thermally conductive communication with a geothermal formation;

a portable heat exchanger unit comprising:

a fluid heat exchanger;

a primary heat exchanger tubing coupling disposed in fluid communication with the fluid heat exchanger;

a secondary heat exchanger tubing coupling disposed in fluid communication with the fluid heat exchanger;

a primary fluid pump disposed in fluid communication with the fluid heat exchanger;

a secondary fluid pump disposed in fluid communication with the fluid heat exchanger;

a primary fluid pump tubing connector disposed in fluid communication with the primary fluid pump; and a secondary fluid pump tubing connector disposed in fluid communication with the primary fluid pump;

a portable energy generating unit configured to generate and utilize thermal energy from the geothermal well, the portable energy generating unit comprising:

a turbine;

a turbine tubing coupling disposed in fluid communication with the turbine;

an electrical generator drivingly engaged by the turbine; and an electrical conduit coupling disposed in electrical communication with the electrical generator, the electrical conduit coupling configured to facilitate electrical connection to an outlet for utilization of electrical power generated by the electrical generator;

a portable cooling tower unit comprising:

at least one cooling tower;

an inlet cooling tower tubing coupling disposed in fluid communication with the cooling tower;

an outlet cooling tower tubing coupling disposed in fluid communication with the cooling tower;

a primary fluid loop comprising the fluid heat exchanger, the primary fluid pump, the geothermal well and a recirculation conduit releasably coupled to the primary fluid pump tubing connector of the primary fluid pump, releasably coupled to the wellhead and releasably coupled to the primary heat exchanger tubing coupling of the fluid heat exchanger; and a secondary fluid loop comprising the fluid heat exchanger, the secondary fluid pump, and the turbine of the portable energy generating unit and a fluid return conduit releasably coupled to the turbine tubing coupling of the turbine, releasably coupled to the inlet cooling tower tubing and the outlet cooling tower tubing of the portable cooling tower unit and releasably coupled to the secondary heat exchanger tubing coupling of the fluid heat exchanger.

18. The system of claim 17, wherein the geothermal well is fluidly sealed from the geothermal formation.

19. The system of claim 17, wherein the secondary fluid loop comprises the at least one cooling tower.

20. The system of claim 17, wherein each of the portable heat exchanger unit and the portable energy generating unit comprises a trailer, a railroad flatcar, a runner car, or a cargo container.

* * * * *